US012740617B2

(12) United States Patent
Cavaliere et al.

(10) Patent No.: US 12,740,617 B2
(45) Date of Patent: Sep. 22, 2026

(54) ATHLETIC SYSTEMS

(71) Applicant: NIKE, Inc., Beaverton, OR (US)

(72) Inventors: Sergio Cavaliere, Venice (IT); John W. Cross, Portland, OR (US); Neil Crumbleholme, Lake Oswego, OR (US); Roberto De Marchi, Volpago del Montello (IT); Samuel G. Lacey, Portland, OR (US); Ryan R. Larson, Portland, OR (US); Marlon Rainville, Portland, OR (US); Matthew R. Tegenkamp, Portland, OR (US)

(73) Assignee: NIKE, INC., Beaverton, OR (US)

( * ) Notice: Subject to any disclaimer, the term of this patent is extended or adjusted under 35 U.S.C. 154(b) by 0 days.

(21) Appl. No.: 18/794,574

(22) Filed: Aug. 5, 2024

(65) Prior Publication Data

US 2026/0033594 A1 Feb. 5, 2026

(51) Int. Cl.
*A43B 5/06* (2022.01)
*A43B 5/18* (2006.01)
(Continued)

(52) U.S. Cl.
CPC ..... *A43B 13/20* (2013.01); *A43B 5/06* (2013.01); *A43B 5/185* (2013.01); *A43B 13/16* (2013.01)

(58) Field of Classification Search
CPC ..... A43B 5/06; A43B 13/148; A43B 13/185; A43B 13/189; A43B 13/20; A43B 13/203; A43B 13/206
See application file for complete search history.

(56) References Cited

U.S. PATENT DOCUMENTS 4,305,212 A 12/1981 Coomer
4,449,306 A 5/1984 Cavanagh
(Continued)

FOREIGN PATENT DOCUMENTS

CN 107114858 A 9/2017
CN 114680423 A 7/2022
(Continued)

OTHER PUBLICATIONS

D. Salas, PT, DPT, and CSCS, "Hoka One One Speed Evo R—Track Spike Review," Apr. 1, 2021. https://www.doctorsofrunning.com/2021/04/hoka-one-one-speed-evo-r-track-spike.html (accessed Jul. 18, 2024).
(Continued)

*Primary Examiner* — Sharon M Prange
(74) *Attorney, Agent, or Firm* — Bookoff McAndrews, PLLC

(57) ABSTRACT

An article of footwear with: an upper; and a sole structure coupled to the upper, the sole structure comprising: a sleeve extending from a first end to a second end, the sleeve including: a first plate having a first surface and a second surface opposite the first surface, the first plate extending from the first end to the second end; a second plate having a first surface and a second surface opposite the first surface of the second plate, the second plate extending from the first end toward the second end; a first cushioning element disposed on the medial side of the article footwear, wherein the first cushioning element is disposed between the first plate and the second plate; a second cushioning element coupled to the first plate; and a third cushioning element disposed between the first plate and the second plate.

18 Claims, 14 Drawing Sheets

(51) Int. Cl.
*A43B 13/16* (2006.01)
*A43B 13/20* (2006.01)

(56) References Cited

U.S. PATENT DOCUMENTS

| | | | | |
|---|---|---|---|---|
| 4,484,397 | A | 11/1984 | Curley, Jr. | |
| 4,949,476 | A | 8/1990 | Anderie | |
| 5,243,776 | A | 9/1993 | Zelinko | |
| 5,279,051 | A | 1/1994 | Whatley | |
| 5,572,805 | A | 11/1996 | Giese et al. | |
| 5,701,687 | A | 12/1997 | Schmidt et al. | |
| 5,813,146 | A | 9/1998 | Gutkowski et al. | |
| 5,881,478 | A | 3/1999 | McMahon et al. | |
| 6,550,160 | B2 | 4/2003 | Miller, II | |
| 6,568,102 | B1 * | 5/2003 | Healy | A43B 13/20 36/35 R |
| 6,789,331 | B1 | 9/2004 | Ellis, III | |
| 6,860,034 | B2 | 3/2005 | Schmid | |
| 7,143,529 | B2 | 12/2006 | Robinson, Jr. et al. | |
| 7,194,826 | B2 | 3/2007 | Ungari | |
| 7,278,445 | B2 | 10/2007 | Marvin et al. | |
| 7,290,358 | B2 | 11/2007 | Francis | |
| 7,395,616 | B2 | 7/2008 | Fallon | |
| 7,472,496 | B2 | 1/2009 | Potter et al. | |
| 7,540,100 | B2 | 6/2009 | Pawlus et al. | |
| 7,770,306 | B2 | 8/2010 | Lyden | |
| 7,788,824 | B2 | 9/2010 | Hann | |
| 8,112,905 | B2 | 2/2012 | Bemis et al. | |
| 8,186,081 | B2 | 5/2012 | Wilson et al. | |
| 8,453,349 | B2 | 6/2013 | Auger et al. | |
| 8,656,611 | B2 | 2/2014 | Baucom et al. | |
| 8,752,306 | B2 | 6/2014 | Goldston et al. | |
| 8,819,965 | B2 | 9/2014 | Baker et al. | |
| 9,241,535 | B2 | 1/2016 | Baudouin et al. | |
| 9,357,813 | B2 | 6/2016 | Lyden | |
| 9,615,627 | B2 | 4/2017 | Nurse et al. | |
| 9,655,400 | B2 | 5/2017 | Selner | |
| 9,756,904 | B2 | 9/2017 | Orand | |
| 9,808,045 | B2 | 11/2017 | Carlson et al. | |
| 9,961,960 | B2 | 5/2018 | Desmarais | |
| 10,010,137 | B2 | 7/2018 | Foxen | |
| 10,575,585 | B2 | 3/2020 | Kirk et al. | |
| 10,743,613 | B2 | 8/2020 | Farris et al. | |
| 10,750,817 | B2 | 8/2020 | Barnes et al. | |
| 10,758,001 | B2 | 9/2020 | Case et al. | |
| 10,791,795 | B2 | 10/2020 | Campos, II et al. | |
| 11,076,659 | B2 | 8/2021 | Baker | |
| 11,284,669 | B2 | 3/2022 | Reinhardt et al. | |
| 11,412,812 | B2 | 8/2022 | Barnes et al. | |
| 11,583,032 | B2 | 2/2023 | Weast et al. | |
| 11,612,209 | B2 | 3/2023 | Ashcroft et al. | |
| 11,617,412 | B2 | 4/2023 | Orand | |
| 11,622,603 | B2 | 4/2023 | Elder et al. | |
| 12,161,190 | B1 | 12/2024 | Razon | |
| 2003/0154628 | A1 | 8/2003 | Gyr | |
| 2008/0052960 | A1 | 3/2008 | Belley et al. | |
| 2008/0072462 | A1 | 3/2008 | Fusco | |
| 2013/0312288 | A1 | 11/2013 | Colthurst | |
| 2015/0157089 | A1 | 6/2015 | Schumacher et al. | |
| 2016/0073732 | A1 | 3/2016 | Ernst et al. | |
| 2017/0095030 | A1 | 4/2017 | Brandstätter | |
| 2019/0110551 | A1 * | 4/2019 | Walker | G01B 7/30 |
| 2019/0320759 | A1 | 10/2019 | Conrad et al. | |
| 2020/0375310 | A1 * | 12/2020 | Weast | A43B 7/1425 |
| 2021/0030112 | A1 | 2/2021 | Amoako et al. | |
| 2021/0052037 | A1 * | 2/2021 | Greenspan | A43B 13/20 |
| 2021/0085024 | A1 * | 3/2021 | Chen | A43B 13/145 |
| 2021/0145121 | A1 | 5/2021 | Page | |
| 2021/0169170 | A1 | 6/2021 | Fahmi et al. | |
| 2021/0361030 | A1 * | 11/2021 | Hopkins | A43B 7/14 |
| 2022/0015502 | A1 | 1/2022 | Goldston et al. | |
| 2022/0225729 | A1 * | 7/2022 | Bonin | A43B 13/145 |
| 2022/0248804 | A1 | 8/2022 | Chang et al. | |
| 2023/0127595 | A1 | 4/2023 | Chang et al. | |
| 2023/0142549 | A1 * | 5/2023 | Dunning | A43B 13/125 36/25 R |
| 2023/0172311 | A1 | 6/2023 | Walker et al. | |
| 2023/0189926 | A1 * | 6/2023 | Hardman | A43B 13/186 36/29 |
| 2023/0270207 | A1 | 8/2023 | Stauffer | |
| 2023/0337785 | A1 | 10/2023 | Kobayashi et al. | |
| 2024/0373980 | A1 | 11/2024 | Andrews et al. | |
| 2025/0204637 | A1 * | 6/2025 | Corcoran-Tadd | A43B 3/246 |
| 2025/0204638 | A1 * | 6/2025 | Wölfel | A43B 3/246 |

FOREIGN PATENT DOCUMENTS

| | | | | |
|---|---|---|---|---|
| CN | 114766776 | B | 11/2023 | |
| DE | 2805426 | A1 | 8/1979 | |
| EP | 3761825 | A1 | 1/2021 | |
| EP | 3749130 | B1 * | 1/2025 | A43B 13/141 |
| GB | 1144676 | A | 3/1969 | |
| WO | 2021001573 | A1 | 1/2021 | |

OTHER PUBLICATIONS

"Asics Javelin Pro 3—Mens Throwing Spikes—Sunrise Red/Black," Sportitude. https://www.sportitude.com.au/p/asics-javelin-pro-3-sunrise-red-black (accessed Jul. 18, 2024).

On Cloudspike 1500m. On. Publication date not available. <> (accessed Jul. 18, 2024). 3 pages.

Hoka Cielo X 2 MD. Accessed: Jan. 30, 2024. Available at: https://www.hoka.com/en/au/spikes/cielo-x-2-md/1134534.html?dwvar_1134534_color=CEPR.

Long JT, Sirota N, Klein JP, Wertsch JJ, Janisse D, Harris GF. Biomechanics of the double rocker sole shoe: gait kinematics and kinetics. Conf Proc IEEE Eng Med Biol Soc. 2004;2004:5107-10. doi: 10.1109/IEMBS.2004.1404411. PMID: 17271467; PMCID: PMC2211387 (accessed Jul. 18, 2024).

Nike Air Zoom Maxfly Track & Field Sprinting Spikes. Nike. Available at: https://www.nike.com/t/air-zoom-maxfly-track-field-sprinting-spikes-C2ZBRP/DH5359-600? (accessed Jul. 18, 2024).

Nike Alphafly 2. Accessed: Jan. 30, 2024. Available at: https://www.nike.com/t/alphafly-2-mens-road-racing-shoes-Bstm8X/DN3555-600?.

Nike Dragonfly Spike. Running Warehouse. Publication date not available. Available at: https://www.runningwarehouse.com/Nike_Dragonfly_Spike/descpage-NZMZD08.html? (accessed Jul. 18, 2024).

On Cloudspike 1500m. Accessed: Jan. 30, 2024. Available at: https://www.on-running.com/en-us/products/cloudspike-1500m-3md1065/mens/undyed-white-mint-shoes-3MD10651105.

Under Armour Sprint Pro 3 Track Spikes. Under Armour. Publication date not available. Available at: https://www.underarmour.com/us/p/track_and_field/unisex_ua_sprint_pro_3_track_spikes/3022516.html? (accessed Jul. 18, 2024).

* cited by examiner

ATHLETIC SYSTEMS

FIELD

The present invention relates in general to articles of footwear, and more particularly, to support systems in articles of footwear with bladder elements.

BACKGROUND

This section provides background information related to the present disclosure which is not necessarily prior art.

Articles of footwear can include sole structures with support systems that enhance the performance of the article and/or the comfort of the wearer. Continued improvements in support systems for articles of footwear are desirable.

BRIEF DESCRIPTION OF THE DRAWINGS

The detailed description of the invention will be described in relation to the accompanying drawings. In the drawings, the following figures have the following general nature.

Corresponding reference numerals indicate corresponding parts throughout the several views of the drawings.

DETAILED DESCRIPTION

Figure 1:
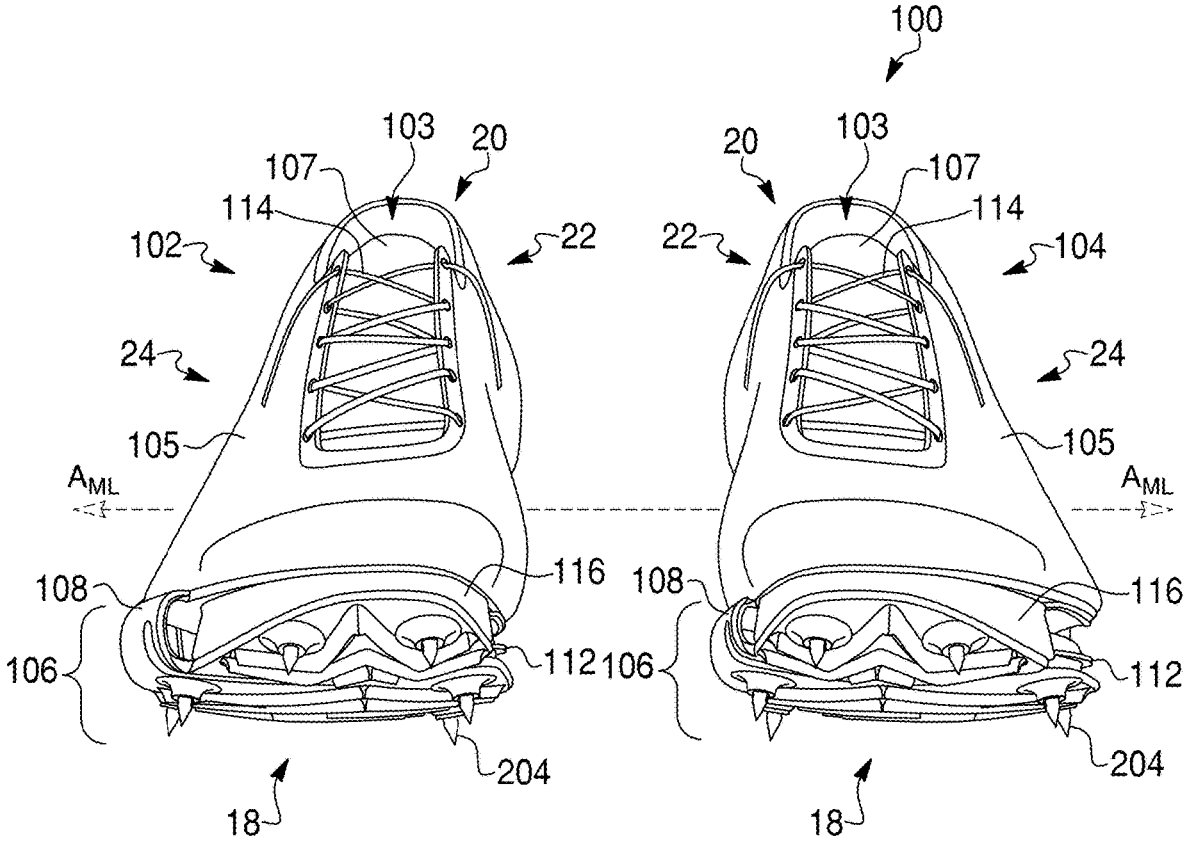
FIG. 1 is a front view of a pair of articles of footwear.

Example configurations will now be described more fully with reference to the accompanying drawings. Example configurations are provided so that this disclosure will be thorough and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer, or section. Terms such as "first," "second," and other numerical terms do not imply a sequence or order unless clearly indicated by the context. Thus, a first element, component, region, layer, or section discussed below could be termed a second element, component, region, layer, or section without departing from the teachings of the example configurations. In the discussion that follows, terms "about," "approximately," "substantially," and the like, when used in describing a numerical value, denote a variation of +/−10% of that value, unless specified otherwise.

When an element or layer includes a directional and/or spatial term (e.g., top, bottom, medial, lateral, etc.), the directional and/or spatial term is used relative to a user's foot anatomy when the article of footwear is being worn by a user. The user is considered to be standing on a flat, level surface.

The subject matter of embodiments of the present disclosure is described with specificity herein to meet statutory requirements. But the description itself is not intended to necessarily limit the scope of claims. Rather, the claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly stated.

Articles of footwear include different types of shoes, sandals, boots, heels, or the like. For the sake of clarity, articles of footwear will be discussed herein as shoes; however, embodiments are not limited solely to shoes. The technology disclosed herein may equally be used to create footwear other than shoes. To alleviate confusion and to provide a more readable disclosure, embodiments simply reference shoes. To that end and to provide a robust disclosure, different component portions of shoes are discussed herein, including uppers, midsoles, and outsoles. One skilled in the art will understand that shoes may include an upper and a sole structure, with the latter comprising an outsole, a midsole, and perhaps an insole.

FIG. 1 depicts a pair of articles of footwear 100. The pair of articles of footwear 100 includes a first (right) article of footwear 102 and a second (left) article of footwear 104. Each of the pair of articles of footwear 100 has an upper 105 coupled to a sole structure 106 (shown in FIG. 2). The sole structure 106 includes a sleeve 108. In an example, a space is formed between respective portions of the sleeve 108, as will be described in further detail below. A first cushioning element 112 and a second cushioning element 116 are disposed within the space formed between respective portions of the sleeve 108. In such an example, the cushioning elements 112, 116 abut interior surfaces of the sleeve 108, as described below. Portions of the sleeve 108 form an outsole of the articles of footwear 100. Portions of the sleeve 108 are configured to be a ground-engaging or ground-contacting surface of the articles of footwear 100.

Portions of the sole structure 106 and the corresponding articles of footwear 100 may be identified based on regions of the user's foot located at or near that portion of the articles of footwear 100 when the footwear is worn on the proper foot by the user. The articles of footwear 100 is divided into a forefoot region, a mid-foot region, and a heel region. The forefoot region including a toe portion corresponding to the phalanges of the foot, and a ball portion corresponding to a metatarsophalangeal (MTP) joint. The mid-foot region corresponding with an arch area of the foot. The heel region corresponding with rear portions of the foot, including a calcaneus bone. The article of footwear 100 include an anterior end 18 at a forward-most point of the forefoot region, and a posterior end 20 at a rearward-most point of the heel region. For ease of discussion, the articles of footwear 100 are discussed with reference to a longitudinal axis $A_L$ (shown in FIG. 2), a medial-lateral axis $A_{ML}$, and a vertical axis Av, where the longitudinal axis $A_L$, the medial-lateral axis $A_{ML}$, and the vertical axis Av are perpendicular to each other. The longitudinal axis $A_L$ of the articles of footwear 100 extends along a longitudinal length of the respective articles of footwear 100 from the anterior end 18 to the posterior end 20, and generally divides the respective articles of footwear 100 into a medial side 22 and a lateral side 24. The medial-lateral axis $A_{ML}$ extends from the medial side 22 to the lateral side 24. Accordingly, the medial side 22 and the lateral side 24 respectively correspond with opposite sides of the respective articles of footwear 100, and each extends from the anterior end 18 to the posterior end 20. The vertical axis Av extends vertically from a bottom (e.g., ground-contacting portion) of the articles of footwear 100 to a top of the articles of footwear 100.

Still referring to FIG. 1, the upper 105 includes interior surfaces that define an interior void (not shown) configured to receive and secure a foot of the user for support on the sole structure 106. The upper 105 may be formed from one or more materials that are stitched, knitted, woven, adhesively bonded, or otherwise joined together to form the interior void. Suitable materials of the upper 105 may include, but are not limited to, mesh, textiles, foam, leather, synthetic leather, and more. The materials are configured and located to impart properties of durability, air-permeability, wear-resistance, flexibility, and/or comfort.

In some examples, the upper 105 includes a strobel (not shown) having a bottom surface opposing the sole structure 106, and an opposing top surface defining a footbed of the interior void. Stitching or adhesives secure the strobel to the upper 105. The footbed is contoured to conform to a profile of the bottom surface (e.g., plantar surface) of the user's foot. In some examples, the upper 105 may incorporate additional layers, such as an insole or sockliner (not shown), that are disposed on the strobel and reside within the interior void of the upper 105 to receive a plantar surface of the foot to enhance the comfort of the articles of footwear 100. An ankle opening 103 in the heel region provides access to the interior void. For example, the ankle opening 103 is sized, shaped, and/or otherwise configured to receive a foot of the user to secure the foot within the interior void, and facilitates entry and removal of the foot from and to the interior void. In some examples, one or more fasteners 114 extend along the upper 105 to adjust a fit of the interior void around the foot, and to accommodate entry and removal of the foot therefrom. The fasteners 114 may include laces, straps, cords, hook-and-loop, pins, or any other suitable type of fastener. The upper 105 can include a tongue portion 107 that extends between the interior void and the fasteners 114.

Sole structures 106 (FIG. 2) can be configured to provide traction for the articles of footwear 100, as well as provide a support structure that supports the foot of a user during walking, jogging, running, or other ambulatory activities. The configuration of sole structures 106 can vary based on use, including the type of ground surfaces on which the sole structures 106 are intended to be used (e.g., road surfaces, track surfaces, natural turf, synthetic turf, dirt, and other surfaces). Additionally, the sole structure 106 may be adaptable in height to provide a desired form of stability during walking, jogging, running, or other ambulatory activities.

For clarity purposes, the following description is in reference to the first article of footwear 102 of the pair of articles of footwear 100. In some examples, the second article of footwear 104 is a mirror of the first article of footwear 102 such that the description provided herein to the first article of footwear 102 may be similarly applicable for describing the second article of footwear 104. In some examples, the first article of footwear 102 and the second article of footwear 104 are symmetric such that respective sole structures 106 are mirrors of one another with respect to the longitudinal axis $A_L$. In other examples, the first article of footwear 102 and the second article of footwear 104 are asymmetric with respect to the longitudinal axis $A_L$. In examples where the first article of footwear 102 and the second article of footwear 104 are symmetric, the first cushioning element 112 of the first article of footwear 102 is disposed on the medial side 22 of the first article of footwear 102. In examples where the first article of footwear 102 and the second article of footwear 104 are symmetric, the first cushioning element 112 of the second article of footwear 104 is disposed on the lateral side 24 of the second article of footwear 104. Such a configuration aids a user of the articles of footwear 100 when performing banking maneuvers (e.g., when turning on a track), as will be described in further detail below.

Figure 2:
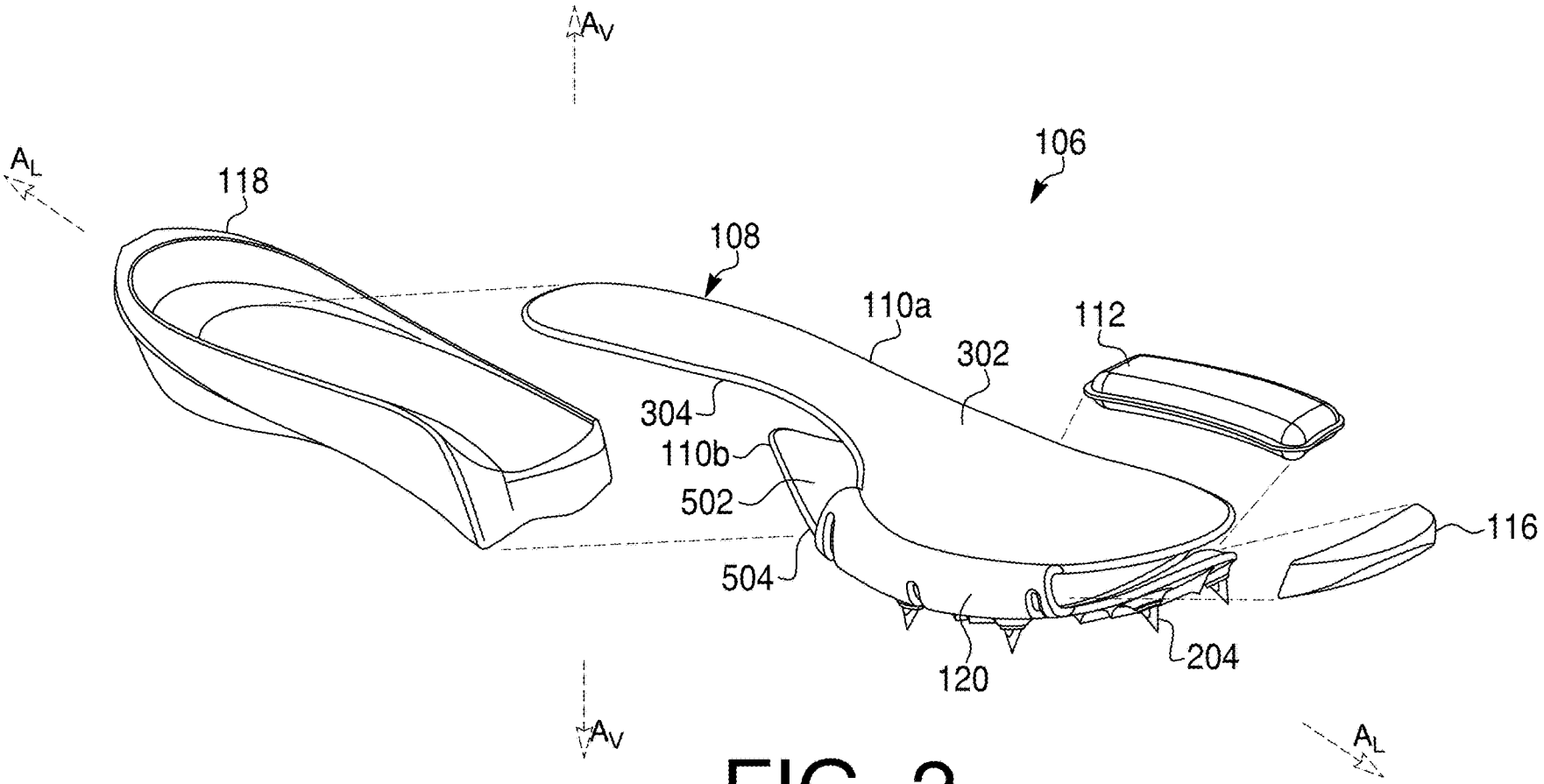
FIG. 2 is an exploded view of a sole structure of an article of footwear of FIG. 1.

FIG. 2 illustrates an exploded view of the sole structure 106 of the articles of footwear 100. The sole structure 106 includes the sleeve 108, the first cushioning element 112, the second cushioning element 116, a third cushioning element 118, and one or more traction elements 204. The sleeve 108 includes a first plate 110*a* and a second plate 110*b*. The first plate 110*a* includes a first surface 302 and a second surface 304 disposed opposite to the first surface 302. The second plate 110*b* includes a first surface 502 and a second surface 504 disposed opposite to the first surface 502. The first plate 110*a* is disposed adjacent to the upper 105 relative to the second plate 110*b* (shown in FIG. 1). The second plate 110*b* forms a ground-engaging surface of the articles of footwear 100. The first plate 110*a* is disposed near the upper 105 relative to the second plate 110*b*. As will be described in greater detail and shown in FIGS. 3A-3B, the first plate 110*a* and the second plate 110*b* are coupled to one another via a brace 120 to allow for the sole structure 106 to move relative to the medial-lateral axis $A_{ML}$ (see FIG. 1).

Figure 3A:
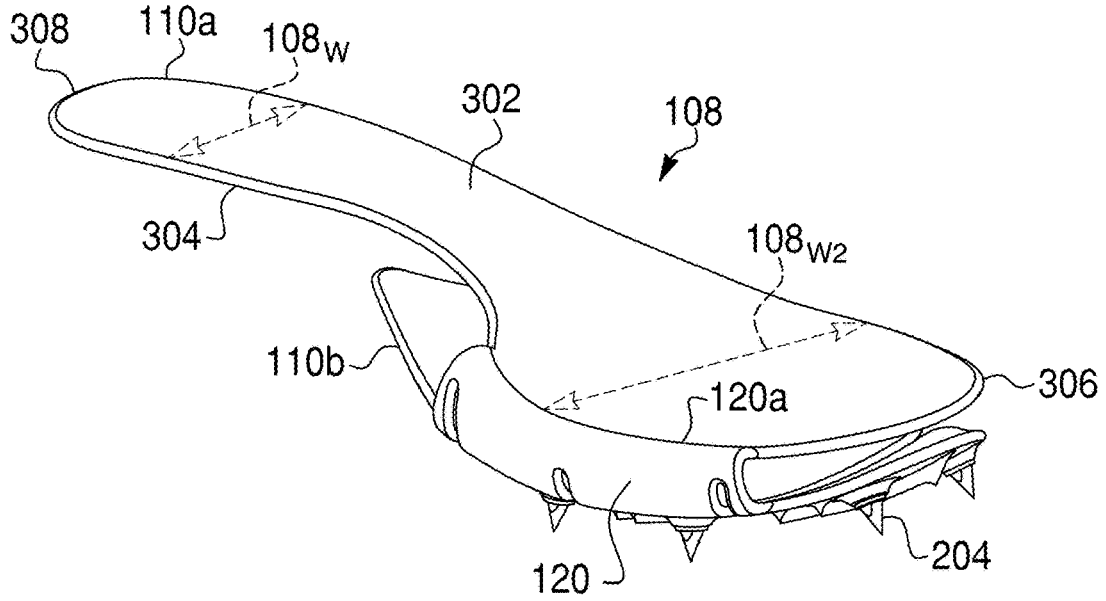
FIG. 3A is a top perspective view of a sleeve of an article of footwear of FIG. 1.
Figure 3B:
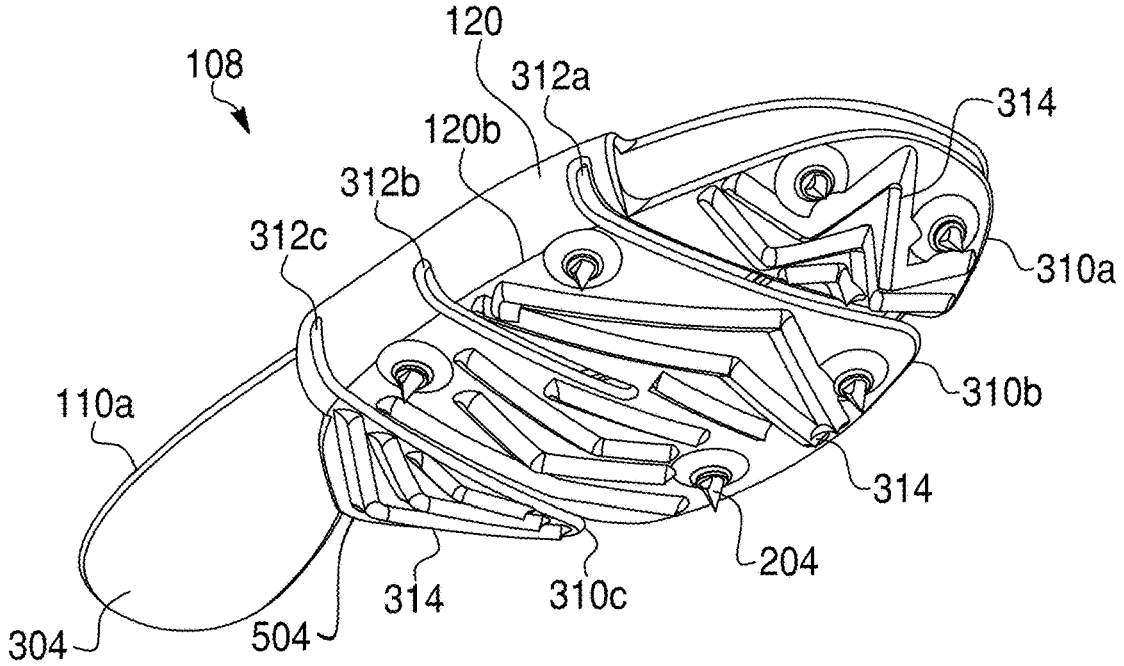
FIG. 3B is a bottom perspective view of the sleeve of FIG. 3A.

FIGS. 3A-3B illustrate various views of the sleeve 108. Referring specifically to FIG. 3A, the first plate 110*a* has a longitudinal length that extends from a first (anterior) end 306 to a second (posterior) end 308. The first end 306 is disposed at the anterior end 18 of the sole structure 106 (see FIG. 1). The second end 308 is disposed at the posterior end 20 of the sole structure 106 (see FIG. 1). In examples, the first plate 110*a* has a variable width between the first end 306 and the second end 308. In an example, the first plate 110*a* includes a first width 108*w*. The first width 108*w* is one width of a narrow portion of the first plate 110*a*. The narrow portion of the first plate 110*a* corresponds with rear portions of the first plate 110*a* adjacent to the second end 308. In other words, the narrow portion of the first plate 110*a* is disposed in the heel region of the sole structure 106. In an example, the first plate 110*a* includes a second width 108*w*2. The second width 108*w*2 is one width of a wide portion of the first plate 110*a*. The wide portion of the first plate 110*a* corresponds with forward portions of the first plate 110*a* adjacent to the first end 306. In other words, the wide portion of the first plate 110*a* is disposed in the forefoot region of the sole structure 106. In an example, the first width 108*w* is smaller than the second width 108*w*2. In some examples, about 50% of the first plate 110*a* has a first width that is the first width 108*w*, and about 50% of the first plate 110*a* has a second width that is the second width 108*w*2. In some examples, between about 10% to about 60% of the first plate 110*a* has a first width that is the first width 108*w*, and about 40% to about 90% of the first plate 110*a* has a second width that is the second width 108*w*2. The first surface 302 of the first plate 110*a* may be coupled to the upper 105 (e.g., via adhesive, cement bond, or the like).

The brace 120 extends from a first end 120*a* coupled to an outer periphery of the first plate 110*a* to a second end 120*b* (shown in FIG. 3B) coupled to an outer periphery of the second plate 110*b*. The brace 120 may be curved between the first end 120*a* and the second end 120*b*. In an example, the brace 120 is flexible to allow the first plate 110*a* to move relative to the medial-lateral axis $A_{ML}$ (see FIG. 1), as will be further described with respect to FIGS. 8A-8C. In some examples, the brace 120 may be comprised of an elastic material (e.g., rubber). In some other examples, the brace 120 may be comprised of a substantially inelastic material.

Referring to FIG. 3B, the second plate 110*b* is coupled to the second end 120*b* of the brace 120. In an example, the second plate 110*b* is subdivided into multiple interconnected pieces. For example, the second plate 110*b* includes a first (anterior) portion 310*a*, a second (central) portion 310*b*, and a third (posterior) portion 310*c*. The first portion 310*a* is a forward-most portion of the second plate 110*b*. The third portion 310*c* is a rear-most portion of the second plate 110*b*. The second portion 310*b* is disposed between the first portion 310*a* and the third portion 310*c*. Each of the first portion 310*a*, the second portion 310*b*, and the third portion 310*c* are coupled to one another via the brace 120. In an example, each of the first portion 310*a*, the second portion 310*b*, and the third portion 310*c* may be integrally formed with the brace 120. In other examples, each of the first portion 310*a*, the second portion 310*b*, and the third portion 310*c* may be compositely formed with the brace 120.

A first slot 312*a* is disposed between the first portion 310*a* and the second portion 310*b*. The first slot 312*a* is formed on and extends along the brace 120 from the medial side 22, through the first portion 310*a* and the second portion 310*b*, and towards the lateral side 24. The first slot 312*a* extends from the brace 120 to an opposite end of the second plate 110*b*. The first slot 312*a* is disposed such that the first portion 310*a* and the second portion 310*b* are not connected to one another. A second slot 312*b* is disposed within the second portion 310*b*. The second slot 312*b* extends from the brace 120 to an area of the second portion 310*b*. In an example, the area may be a central area of the second portion 310*b* between the medial side 22 and the lateral side 24. In some other examples, the second slot 312*b* may extend continuously from the brace 120 towards an opposite end of the second plate 110*b*. A third slot 312*c* is disposed between the second portion 310*b* and the third portion 310*c*. The third slot 312*c* extends from the brace 120 to an opposite end of the second plate 110*b*. The third slot 312*c* is disposed such that the second portion 310*b* and the third portion 310*c* are not connected to one another. In an example, the first slot 312*a* is an anterior-most slot of the slots 312*a*, 312*b*, and 312*c*, such that the first slot 312*a* is positioned adjacent to the first (anterior) end 306 relative to second slot 312*b* and third slot 312*c*. The third slot 312*c* is a rear-most slot of the slots 312*a*, 312*b*, and 312*c*, such that the third slot 312*c* is positioned adjacent to the second (posterior) end 308 relative to first slot 312*a* and second slot 312*b*. The second slot 312*b* is disposed between the first slot 312*a* and the third slot 312*c*.

The first slot 312*a* has a first length. The second slot 312*b* has a second length. The third slot 312*c* has a third length. In an example, the first length of the first slot 312*a* and the third length of the third slot 312*c* are the same and/or substantially similar to one another. The second length of the second slot 312*b* may be less than the respective lengths of the first slot 312*a* and the third slot 312*c*. In other examples, each of the first length, the second length, and the third length may be different from one another. In yet other examples, each of the first length, the second length, and the third length may be the same and/or substantially similar to one another as one another. The first length, the second length, and the third length may be sized as desired to provide a desired form of flexibility to the second plate 110*b*.

The first portion 310*a* includes the one or more traction elements 204 and one or more gripping elements 314. The one or more gripping elements 314 extend outwardly away (e.g., downwards) from the second surface 504. The one or more gripping elements 314 form raised and/or protruding portions on the second surface 304. The second portion 310*b* includes the one or more traction elements 204 and the one or more gripping elements 314. In the example, the third portion 310*c* does not include any traction elements 204, and does include the one or more gripping elements 314. The one or more gripping elements 314 are configured to provide additional traction to the articles of footwear 100. For example, the one or more gripping elements 314 collectively form a substantially triangular pattern along the second surface 504 on one or more of the first portion 310*a*, the second portion 310*b*, and/or the third portion 310*c*. Such a pattern allows for the gripping elements 314 to provide multi-directional traction. In other examples, the one or more gripping elements 314 may from a substantially linear pattern, square pattern, diamond pattern, or any other pattern along the second surface 504 to provide a desired form of traction for the sleeve 108.

Figure 4:
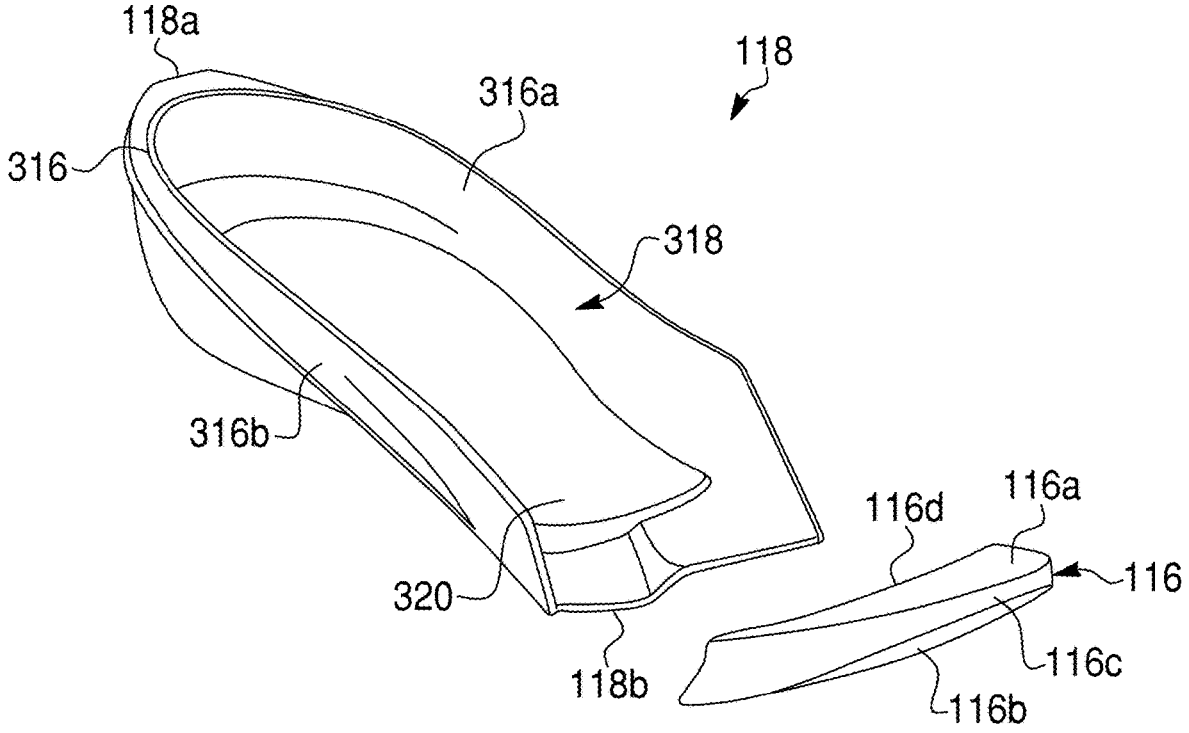
FIG. 4 is a top perspective view of a cushioning element of an article of footwear of FIG. 1.

FIG. 4 illustrates the second cushioning element 116 and the third cushioning element 118. In an example, the second cushioning element 116 is a foamed element. The second cushioning element 116 further includes a first surface 116*a* and a second surface 116*b* opposite the first surface 116*a*. The second cushioning element 116 includes a rounded first end 116*c* and a substantially flat second end 116*d*. When fully assembled, the first surface 116*a* faces the upper 105 (see FIG. 1) and the second surface 116*b* faces the ground surface (not shown). The first surface 116*a* is configured to be coupled to the first plate 110*a*, and the second surface 116*b* is configured to be coupled to the second plate 110*b* (see FIG. 3A).

The third cushioning element 118 extends from a first end 118*a* to a second end 118*b*. The third cushioning element includes a sidewall 316. The sidewall 316 includes a first (inner) surface 316*a* and a second (outer) surface 316*b* disposed opposite to the first surface 316*a*. The sidewall 316 is sized, shaped, and/or otherwise configured to define and/or surround a cavity 318 and a bed 320 of the third cushioning element 118. A cross-sectional profile of the cavity 318 is defined and/or bounded at its rear, adjacent to first end 118A, and lateral sides by the sidewall 316. The cavity 318 is bounded at its bottom by the bed 320. The cavity 318 is open at its front end adjacent to the second end 118*b*. The third cushioning element 118 includes a bottom surface 324 (shown in FIG. 7). The bottom surface 324 forms a ground-engaging portion of the third cushioning element 118. As will be described in detail below, the cavity 318 and the bed 320 are collectively configured to receive the sleeve 108.

Figure 5:
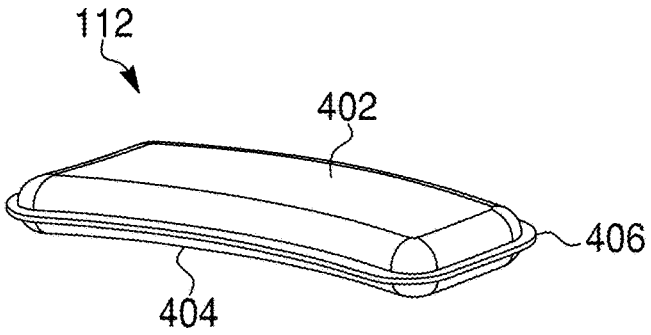
FIG. 5 is a perspective view of a cushioning element of an article of footwear of FIG. 1.

FIG. 5 illustrates a perspective view of the first cushioning element 112. The first cushioning element 112 may be a fluid-filled bladder, for example, that may be inflated and/or deflated to provide a desired form of cushioning and support. The first cushioning element 112 may be formed from a pair of barrier layers 402, 404, which when joined together may define an enclosed inner volume (or hollow interior) for receiving, for example, a pressurized fluid (e.g. a gas, a fluid, etc.). The barrier layers 402, 404 may be joined to each other at discrete locations to define an overall shape of the first cushioning element 112. In an exemplary embodiment, the first cushioning element 112 may include a first, upper barrier layer 402 and a second, lower barrier layer 404. The upper barrier layer 402 may be attached to the lower barrier layer 404 by, for example, applying heat and pressure at a perimeter of the upper barrier layer 402 and the lower barrier layer 404 to define a peripheral seam 406 extending therebetween. The peripheral seam 406 may be configured to seal the first cushioning element 112, and may define the peripheral profile of the first cushioning element 112.

As used herein, the term "barrier layer" (e.g., barrier layers 402, 404) may encompass both monolayer and multilayer films. In some embodiments, one or both of barrier layers 402, 404 may each be produced (e.g., thermoformed or blow molded) from a monolayer film (i.e., a single layer). In other embodiments, one or both of barrier layers 402, 404 may each be produced (e.g., thermoformed or blow molded) from a multilayer film (i.e., multiple sublayers). In either embodiment, each layer or sublayer can have a film thickness ranging from about 0.2 micrometers to about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers. It is contemplated that the first cushioning element 112 may have a thickness ranging from about 6 mm to about 10 mm, although other suitable values are contemplated. In an exemplary embodiment, the first cushioning element 112 may have a thickness of about 8 mm.

One or both of barrier layers 402, 404 may independently be transparent, translucent, and/or opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 402, 404 may each be produced from an elastomeric material that includes one or more thermoplastic polymers and/or one or more cross-linkable polymers. In an embodiment, the elastomeric material can include one or more thermoplastic elastomeric materials, such as one or more thermoplastic polyurethane (TPU) copolymers, one or more ethylene-vinyl alcohol (EVOH) copolymers, and the like.

The first cushioning element 112 may be produced from the barrier layers 402, 404 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an embodiment, the barrier layers 402, 404 can be produced by co-extrusion followed by vacuum thermoforming to produce the first cushioning element 112. In some embodiments, the first cushioning element 112 can include one or more valves (e.g., one-way valves) that allows the first cushioning element 112 to be filled with a fluid (e.g., gas).

The first cushioning element 112 may be provided in a fluid-filled state or an unfilled state. The first cushioning element 112 may be filled to include any suitable fluid, such as a gas or a liquid. In an embodiment, the gas may include air, nitrogen ($N_2$), or any other suitable gas. In other embodiments, the first cushioning element 112 may include other media, such as one or more pellets, beads, ground-recycled material, and the like (e.g., foamed beads and/or rubber beads). The fluid provided to the first cushioning element 112 can result in the first cushioning element 112 being pressurized. In some examples, the first cushioning element 112 may have a pressure ranging from about 15 psi (pounds per square inch) to about 25 psi. In other examples, the first cushioning element 112 may have a pressure ranging from about 20 psi to about 25 psi. In some examples, the first cushioning element 112 may have a pressure of about 20 psi. In other examples, the first cushioning element 112 may have a pressure of about 25 psi. Alternatively, the fluid provided to the first cushioning element 112 may be at atmospheric pressure such that the first cushioning element 112 is not pressurized but, rather, contains a volume of fluid at atmospheric pressure.

The first cushioning element 112 is configured to have a low gas transmission rate to preserve its retained gas pressure. In some embodiments, first cushioning element 112 may have a gas transmission rate for nitrogen gas that is at least about ten (10) times lower than a nitrogen gas transmission rate for a butyl rubber layer of substantially the same dimensions. In an embodiment, first cushioning element 112 may have a nitrogen gas transmission rate of 15 cubic-centimeter/square-meter·atmosphere·day ($cm^3/m^2$·atm·day) or less for an average film thickness of 500 micrometers (based on thicknesses of barrier layers 402, 404). In further embodiments, the transmission rate may be 10 $cm^3/m^2$·atm·day or less, 5 $cm^3/m^2$·atm·day or less, or 1 $cm^3/m^2$·atm·day or less.

In some examples, the first cushioning element 112 may be configured to receive one or more tensile elements therein (not shown). Each tensile element may include a series of tensile strands extending between an upper tensile sheet (not shown) and a lower tensile sheet (not shown). The upper tensile sheet may be attached to the upper barrier layer 402 while the lower tensile sheet may be attached to the lower barrier layer 404. In this manner, when the first cushioning element 112 receives the pressurized fluid, the tensile strands of the tensile element are placed in tension. Because the upper tensile sheet is attached to the upper barrier layer 402 and the lower tensile sheet is attached to the lower barrier layer 404, the tensile strands may be configured to retain a desired shape of the first cushioning element 112 when the pressurized fluid is injected into the chamber.

In an alternative embodiment, the first cushioning element 112 may include a polymer foam and/or particulate matter in one or more, or all, regions of the first cushioning element 112 corresponding to the enclosed inner volume of the first cushioning element 112. For example, the first cushioning element 112 may include a plurality of fluid-filled chambers arranged in the forefoot region of the article of footwear 100, as described in greater detail below. Additionally or alternatively, the first cushioning element 112 may be replaced or supplemented with other cushioning elements. For example, a cushion (not shown) may include a foam block that replaces or supplements the pressurized fluid. The foam block(s) (not shown) may be received between the upper barrier layer 402 and the lower barrier layer 404. Positioning the foam block(s) between the upper barrier layer 402 and the lower barrier layer 404 may allow the barrier layers 402, 404 to restrict expansion of the foam blocks beyond a predetermined amount when subjected to a predetermined load. Accordingly, the overall shape and, thus, the performance of the foam blocks may be controlled by allowing the foam blocks to interact with the barrier layers 402 and 404 during loading. While the foam blocks (not shown) are described as being received between the barrier layers 402 and 404, the foam blocks may alternatively be positioned between the first plate 110*a* and the second plate 110*b* absent the barrier layers 402 and 404. In such a configuration, the foam blocks may be directly attached to the second surface 304 of the first plate 110*a* and to the first surface 502 of the second plate 110*b*, respectively.

In the example, the first cushioning element 112 may be substantially rectangular. In other examples, the first cushioning element 112 may be circular, ovular, irregular, or any other shape suitable for providing a desired form of cushioning, stability, or support.

Figure 6:
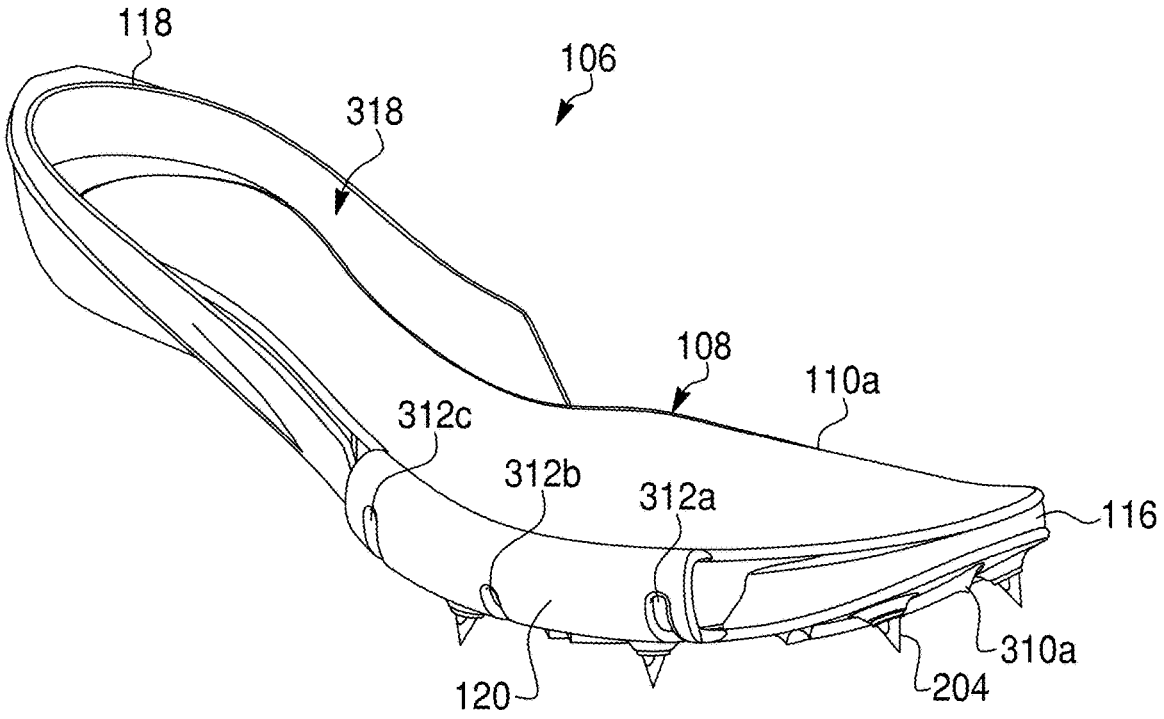
FIG. 6 is a top perspective view of the sole structure of FIG. 2.
Figure 7:
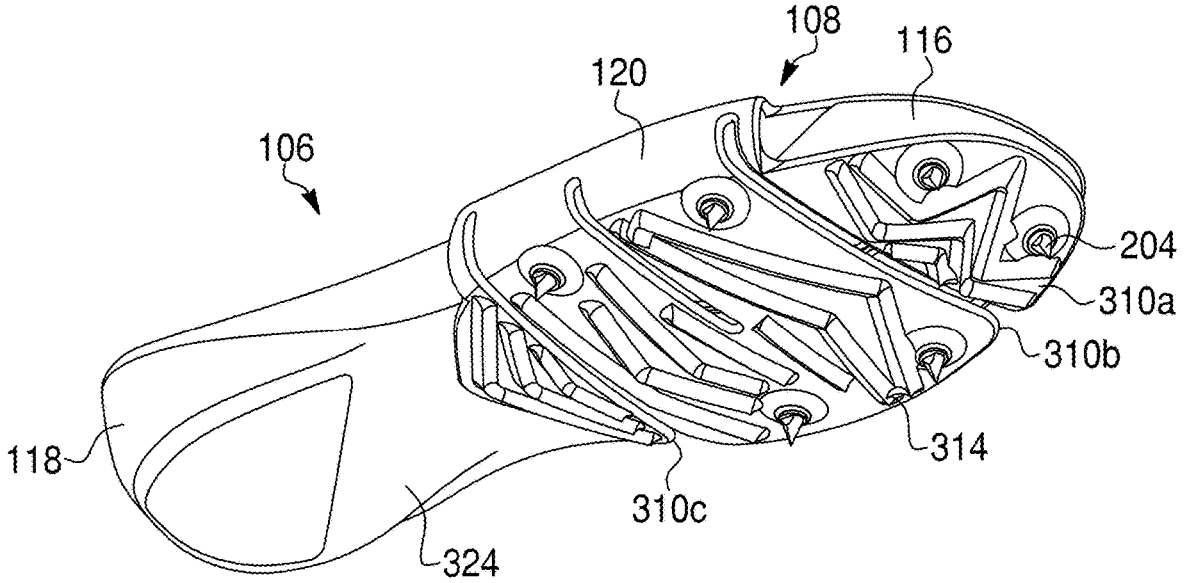
FIG. 7 is a bottom perspective view of the sole structure of FIG. 2.

FIGS. 6 and 7 show the sole structure 106 in its fully assembled configuration. The first plate 110*a* and the second plate 110*b* are coupled to one another via the brace 120. The first cushioning element 112 and the second cushioning element 116 are adhered to respective portions of the sleeve 108. The upper barrier layer 402 of the first cushioning element 112 is adhered to the second surface 304 of the first plate 110*a*. The lower barrier layer 404 of the first cushioning element 112 is adhered to the first surface 502 of the second plate 110*b*. The first surface 116*a* of the second cushioning element 116 is adhered to the second surface 304 of the first plate 110*a*. The second surface 116*b* of the second cushioning element 116 is adhered to the first surface 502 of the second plate 110*b*. The first cushioning element 112 and the second cushioning element 116 may be adhered via an adhesive (e.g., glue) or other suitable attachment mechanism. The first plate 110*a* of the sleeve 108 is disposed within the cavity 318. The third portion 310*c* of the second plate 110*b* is disposed adjacent to the bottom surface 324 of the third cushioning element 118. The brace 120 is configured to couple the first plate 110*a* and the second plate 110*b* to one another on the lateral side 24, which allows the first plate 110*a* to move (e.g., pivot) relative to the second plate 110*b*, such as towards the medial side 22 and the first cushioning element 112.

As will be described herein, to provide a banking angle relative to a ground surface shown in FIG. 8A, the first cushioning element 112 of the first article of footwear 102 is positioned on the medial side 22 and the first cushioning element 112 of the second article of footwear 104 is positioned on the lateral side 24, as shown in FIG. 1. It should be appreciated that the banking angle is an angle formed along the second surface 304 of the first plate 110*a* relative to the ground surface when the user of the article of footwear 100 is, for example, turning around a corner on a track.

Figure 8A:
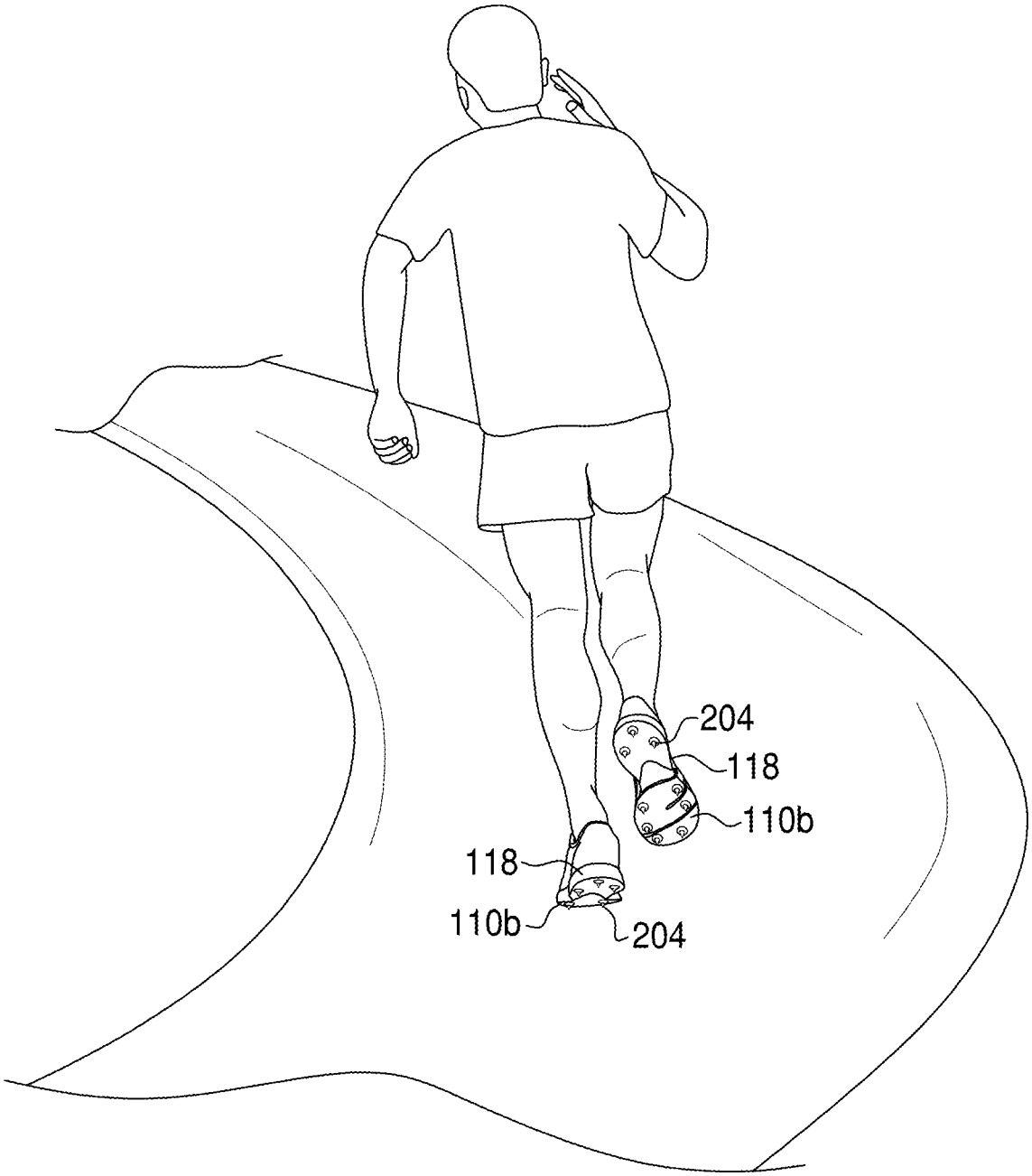
FIG. 8A is an exemplary view of a user wearing the articles of footwear of FIG. 1.
Figure 8B:
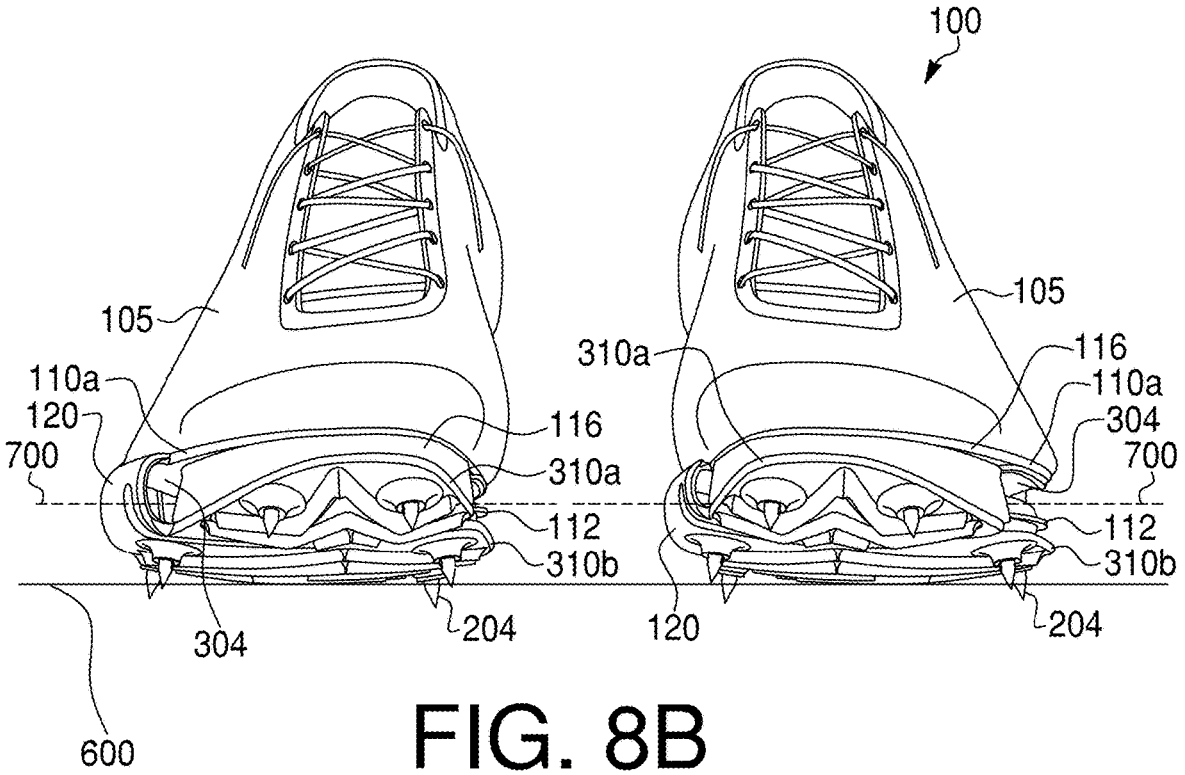
FIG. 8B is a front view of the articles of footwear of FIG. 1 in a first configuration.
Figure 8C:
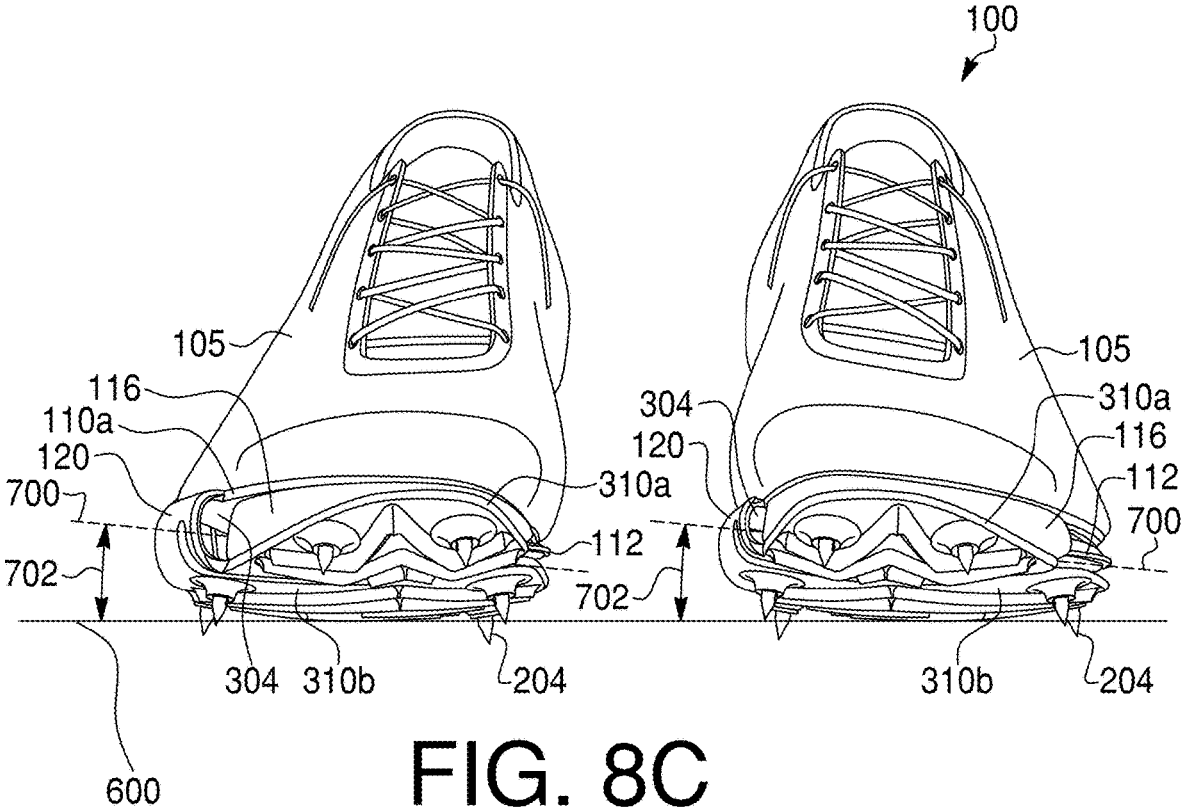
FIG. 8C is a front view of the articles of footwear of FIG. 1 in a second configuration.

FIGS. 8A-8C show a changing banking angle for the articles of footwear 100. FIG. 8A shows a user of the article of footwear 100 banking while using the articles of footwear 100. As shown in FIG. 8B, a neutral position of the articles of footwear 100 is shown when the user is running straight and a plane 700 extending along the second surface 304 of the first plate 110*a* is substantially parallel with a ground surface 600. In the neutral position, each article of footwear 102, 104 is substantially parallel to the ground surface 600, and has a minimum banking angle relative to the ground surface 600, which in some examples will be approximately zero or a zero-banking angle. As shown in FIG. 8C, a banked position of the articles of footwear 100 is shown, such as when the user is running along a bank (e.g., a sloped surface on a track) and the articles of footwear 100 tilts to form an angle (e.g., a banking angle) 702 between the ground surface 600 and the plane 700. As the user banks, the user's weight moves (e.g., pivots) the first plate 110*a* towards and/or onto the first cushioning element 112. The first plate 110*a* is configured to compress the first cushioning element 112. The first cushioning element 112 may be compressed to a maximum compression limit of the first cushioning element 112. As the user comes out of the bank, the first cushioning element 112 is configured to apply restorative forces to push the first plate 110*a* back towards the neutral position shown in FIG. 8B in response to the user exiting the bank and the user's weight shifting. As the first plate 110*a* returns to the neutral position after banking, the brace 120 is configured to maintain the first plate 110*a* from extending past the neutral position to still allow the user's weight to shift while maintaining structural integrity of the sleeve 108.

In some examples, the first cushioning element 112 may be fully compressed to about 100% of the compression limit of the first cushioning element 112. In some examples, the first cushioning element 112 may be partially compressed to any percentage of the compression limit of the first cushioning element 112, corresponding to the force applied by the user of the articles of footwear 100. In some examples, the first cushioning element 112 may be partially compressed to about 75% of the compression limit of the first cushioning element 112. In some examples, the first cushioning element 112 may be partially compressed to about 50% of the compression limit of the first cushioning element 112. In some examples, the first cushioning element 112 may be partially compressed to about 25% of the compression limit of the first cushioning element 112.

The compression of the first cushioning element 112 provides the desired banking angle 702, which can vary depending on use application of the articles of footwear 100. For example, with a maximum banking angle 702 of about 20 degrees, the desired banking angle would be able to vary between about 0 and about 20 degrees. In some examples, higher or lower maximum banking angles can be achieved. In some examples, the maximum banking angle 702 is about 30 degrees. In some examples, the maximum banking angle 702 is about 50 degrees. In some examples, the maximum banking angle 702 is about 80 degrees. In some examples, the maximum banking angle 702 is about 18 degrees. In some examples, the maximum banking angle 702 is about 15 degrees. In some examples, the maximum banking angle 702 is about 10 degrees.

Figure 9:
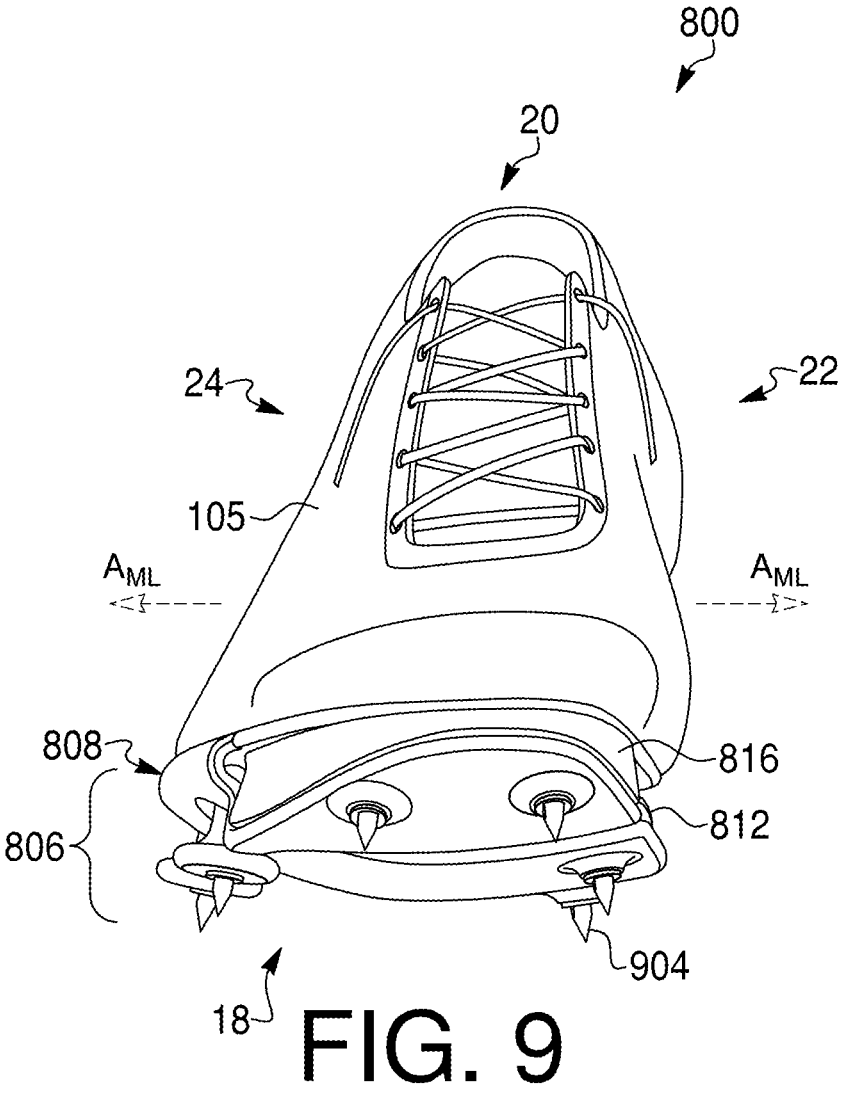
FIG. 9 is a front view of another article of footwear.

FIG. 9 depicts an article of footwear 800. Article of footwear 800 may be substantially similar to the articles of footwear 100 except as described below. For example, the article of footwear 800 includes a sole structure 806. The sole structure 806 includes a sleeve 808, a first cushioning element 812 that is disposed between respective portions of the sleeve 808, and a second cushioning element 816 disposed between respective portions of the sleeve 808. Portions of the sleeve 808 form an outsole of the article of footwear 800. Portions of the sleeve 808 are configured to be a ground-engaging or ground-contacting surface of the article of footwear 800.

For clarity purposes, the following description is in reference to a first article of footwear of the article of footwear 800. In some examples, a second article of footwear of the article of footwear 800 is substantially similar to the first article of footwear. In some examples, the first article of footwear and the second article of footwear of the article of footwear 800 are symmetric with respect to the longitudinal axis $A_L$. In other examples, the first article of footwear and the second article of footwear of the article of footwear 800 are asymmetric with respect to the longitudinal axis $A_L$. In examples where the first article of footwear and the second article of footwear of the article of footwear 800 are symmetric, the first cushioning element 812 of the first article of footwear 802 is disposed on the medial side 22, and the first cushioning element 812 of the second article of footwear 804 is disposed on the lateral side 24. Such a configuration aids a user of the article of footwear 800 when performing banking maneuvers (e.g., when turning on a track), as will be described in further detail below.

Figure 10A:
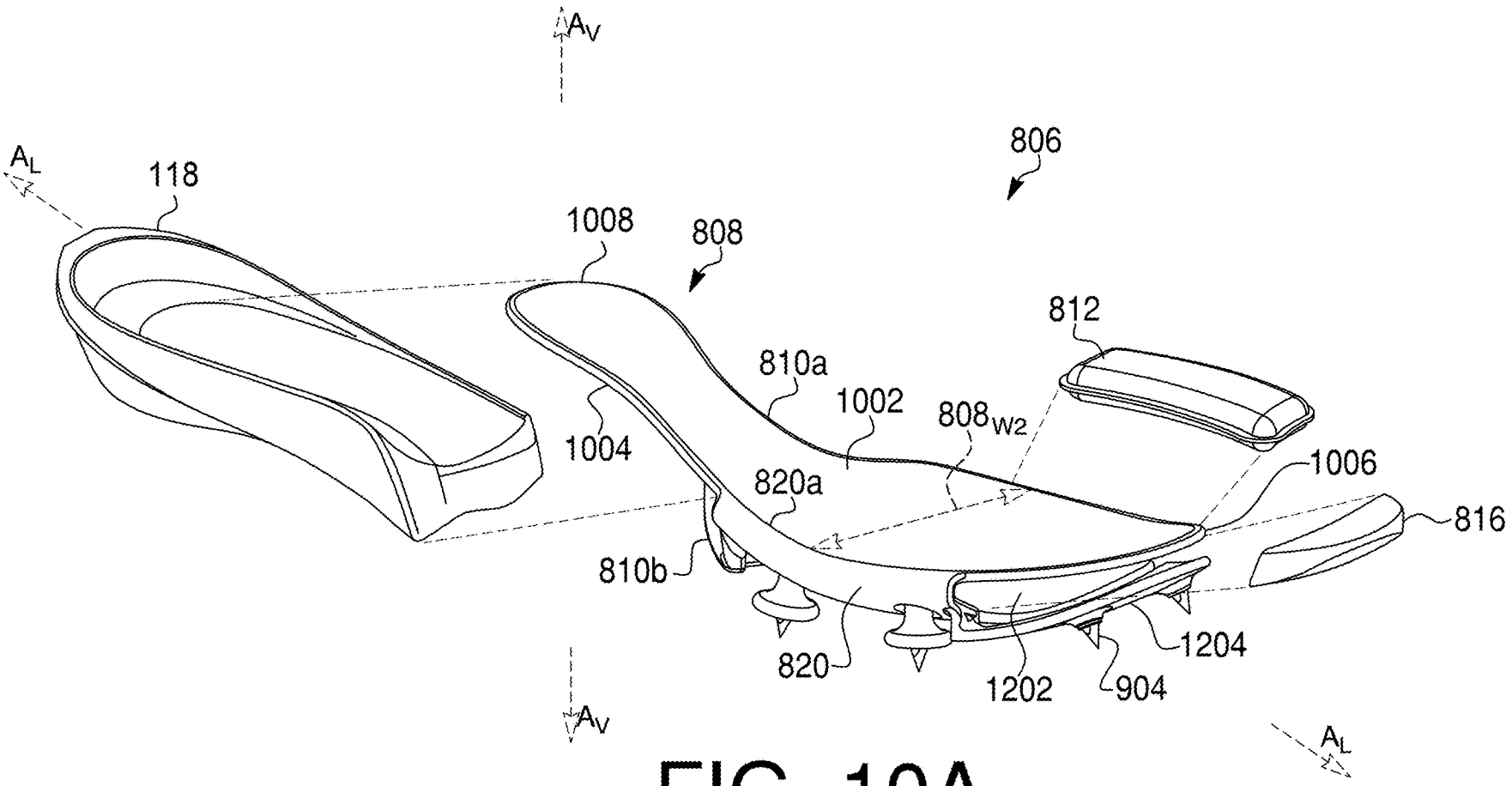
FIG. 10A is an exploded view of a sole structure of the article of footwear of FIG. 9.

FIG. 10A illustrates an exploded view of the sole structure 806. The sleeve 808 includes a first plate 810*a*, a second plate 810*b*, the first cushioning element 812, the second cushioning element 816, and one or more traction elements 904. The first plate 810*a* includes a first surface 1002 and a second surface 1004 disposed opposite to the first surface 1002. The second plate 810*b* includes a first surface 1202 and a second surface 1204 disposed opposite to the first surface 1202. The first plate 810*a* is disposed adjacent to the upper 105 (shown in FIG. 9). The second plate 810*b* forms a ground-engaging surface of the article of footwear 800. The first plate 810*a* is disposed near the upper 805 relative to the second plate 810*b*.

Still referring to FIG. 10A, the sole structure 806 includes the third cushioning element 118. The first cushioning element 812, the second cushioning element 816, and the third cushioning element 118 shown in FIG. 10A are arranged and configured in a substantially similar manner as the first cushioning element 112, the second cushioning element 116, and the third cushioning element 118, respectively shown in FIG. 2. As will be described in greater detail below, the first plate 810*a* and the second plate 810*b* are coupled to one another via a brace 820 to allow for the sole structure 806 to move relative to the medial-lateral axis $A_{ML}$.

The first plate 810*a* has a longitudinal length that extends from a first (anterior) end 1006 to a second (posterior) end 1008. The first end 1006 is disposed adjacent the anterior end 18 of the sole structure 806. The second end 1008 is disposed adjacent the posterior end 20 of the sole structure 806. In examples, the first plate 810*a* has a variable width. In an example, the first plate 810*a* includes a first width 808*w*. The first width 808*w* is one width of a narrow portion of the first plate 810*a*. The narrow portion of the first plate 810*a* corresponds with rear portions of the first plate 810*a* adjacent to the second end 1008. In other words, the narrow portion of the first plate 810*a* is disposed in the heel region of the sole structure 806. In an example, the first plate 810*a* includes a second width 808*w*2. The second width 808*w*2 is one width of a wide portion of the first plate 810*a*. The wide portion of the first plate 810*a* corresponds with forward portions of the first plate 810*a* adjacent to the first end 1006. In other words, the wide portion of the first plate 810*a* is disposed in the forefoot region of the sole structure 806. In an example, the first width 808*w* is smaller than the second width 808*w*2. In some examples, about 50% of the first plate 810*a* has a first width that is the first width 808*w* while about 50% of the first plate 810*a* has a second width that is the second width 808*w*2. In some examples, between about 10% to about 60% of the first plate 810*a* has a first width that is the first width 808*w* while about 40% to about 90% of the first plate 810*a* has a second width that is the second width 808*w*2. The first surface 1002 of the first plate 810*a* may be coupled to the upper 105 (see FIG. 9).

Figure 10B:
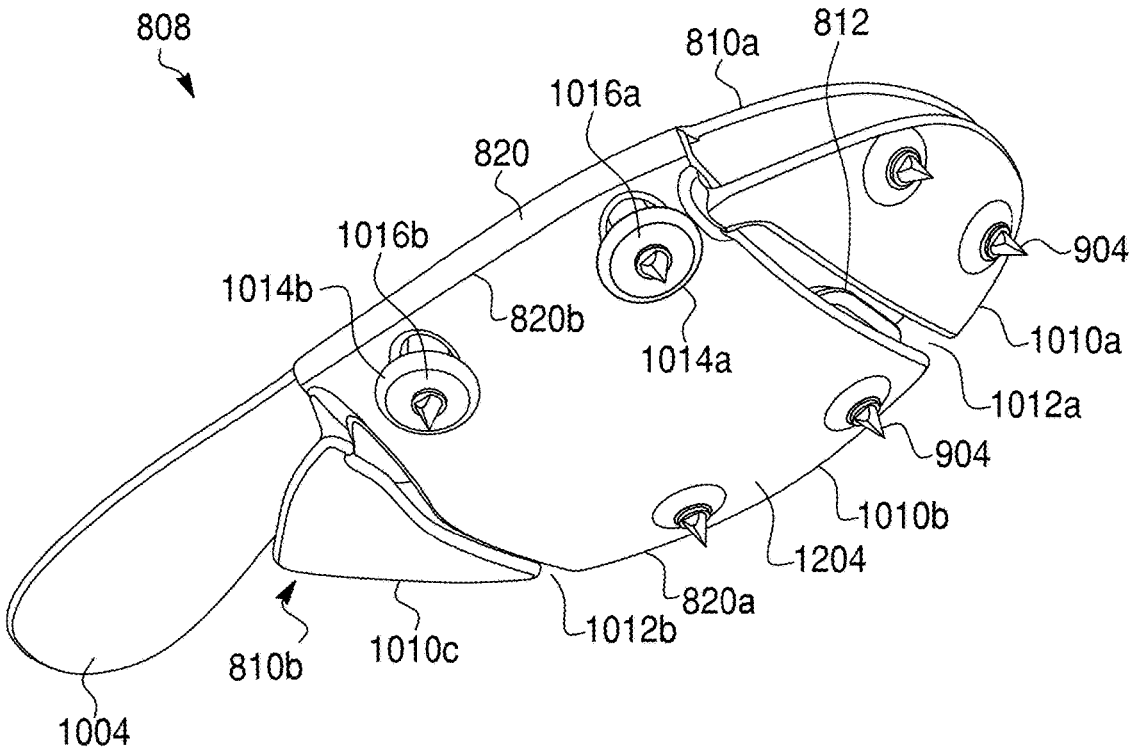
FIG. 10B is a bottom perspective view of a sleeve of the article of footwear of FIG. 9.

FIG. 10B illustrates a bottom view of the sleeve 808 with the first cushioning element 812. The brace 820 extends from a first end 820*a* coupled to an outer periphery of the first plate 810*a* to a second end 820*b* coupled to an outer periphery of the second plate 810*b*. The brace 820 may be curved between the first end 820*a* and the second end 820*b*. In an example, the brace 820 is flexible to allow the first plate 810*a* to move relative to the medial-lateral axis $A_{ML}$, as will be further described with respect to FIGS. 13A-13C. In some examples, the brace 820 may be comprised of an elastic material (e.g., rubber). In some other examples, the brace 820 may be comprised of a substantially inelastic material.

The second plate 810*b* is coupled to the second end 820*b* of the brace 820. In an example, the second plate 810*b* is subdivided into multiple pieces that may be connected to one another, for example, the second plate 810*b* includes a first (anterior) portion 1010*a*, a second (central) portion 1010*b*, and a third (posterior) portion 1010*c*. The first portion 1010*a* is a forward-most portion of the second plate 810*b*. The third portion 1010*c* is a rear-most portion of the second plate 810*b*. The second portion 1010*b* is disposed between the first portion 1010*a* and the third portion 1010*c*. Each of the first portion 1010*a*, the second portion 1010*b*, and the third portion 1010*c* are coupled with the brace 820. In an example, each of the first portion 1010*a*, the second portion 1010*b*, and the third portion 1010*c* may be integrally formed with the brace 820. In other examples, each of the first portion 1010*a*, the second portion 1010*b*, and the third portion 1010*c* may be compositely formed with the brace 820.

A first slot 1012*a* is disposed between the first portion 1010*a* and the second portion 1010*b*. The first slot 1012*a* extends from a portion of the first portion 1010*a* that is coupled to the second portion 1010*b* to an opposite end of the second plate 810*b*. A second slot 1012*b* is disposed between the second portion 1010*b* and the third portion 1010*c*. The third slot 312*c* extends from a portion of the third portion 1010*c* that is coupled to the second portion 1010*b* to an opposite end of the second plate 810*b*. In some examples, inner portions of the sleeve 808 may be visible through each of the slots 1012*a*, 1012*b*.

The first portion 1010*a* and the second portion 1010*b* includes the one or more traction elements 904. The second portion 1010*b* further includes a first spike 1014*a* and a second spike 1014*b*. The first spike 1014*a* is disposed adjacent to the first portion 1010*a* relative to the second spike 1014*b*. The second spike 1014*b* is disposed adjacent to the third portion 101*c* relative to the first spike 1014*a*. In an example, the first spike 1014*a* and the second spike 1014*b* each extends from the first plate 810*a* and through the brace 820. The first spike 1014*a* includes a first surface 1016*a* forming a portion of a ground-engaging surface of the first spike 1014*a*. The second spike 1014*b* includes a first surface 1016*b* forming a portion of a ground-engaging surface of the second spike 1014*b*. The third portion 1010*c* does not include any of the one or more traction elements 904 or the spikes 1014*a*, 1014*b*. In some examples, the first spike 1014*a* and the second spike 1014*b* may be flexible, biased, and/or selectively deformable, such as upon an application of force thereto, along the vertical axis Av. In such examples, the first spike 1014*a* and the second spike 1014*b* are configured to move (e.g., pivot, translate, etc.) the first plate 810*a* along the medial-lateral axis $A_{ML}$, such as in response to a foot of the user during movement.

In some examples, the one or more traction elements 904 are permanently affixed to the second surface 1204. In some examples, the spikes 1014*a*, 1014*b* are configured to be removed from the first plate 810*a* and replaced, such as with one or more additional spikes 1014*a*, 1014*b*. In other examples, the one or more traction elements 904 are configured to be removed from the second plate 810*b* and replaced, such as with one or more additional traction elements 904.

Figure 10C:
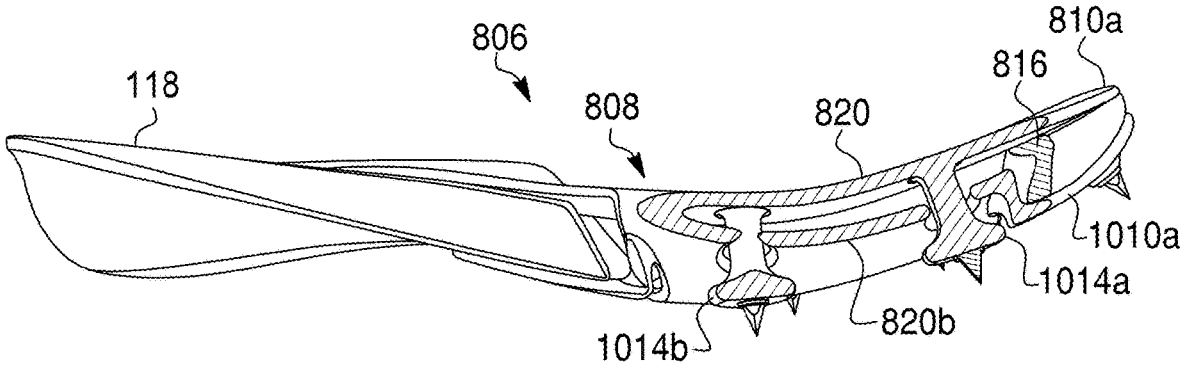
FIG. 10C is a cross-sectional view of the sleeve of FIG. 10B.

FIG. 10C shows a cross-sectional view of the sleeve 808. The first spike 1014*a* and the second spike 1014*b* are sized, shaped, and/or otherwise to extend through the brace 820 towards the first plate 810*a*. In an example, the first spike 1014*a* and the second spike 1014*b* are coupled with the first plate 810*a* such that when a force that is substantially parallel to the vertical axis Av is applied, greater portions of each of the first spike 1014*a* and the second spike 1014*b* extend further through the brace 820 and the second portion 1010*b*. As will be described in further detail below, the first spike 1014*a* and the second spike 1014*b* push the first plate 810*a* of the sleeve 808 towards the medial side 24 and onto the first cushioning element 812.

Figure 11:
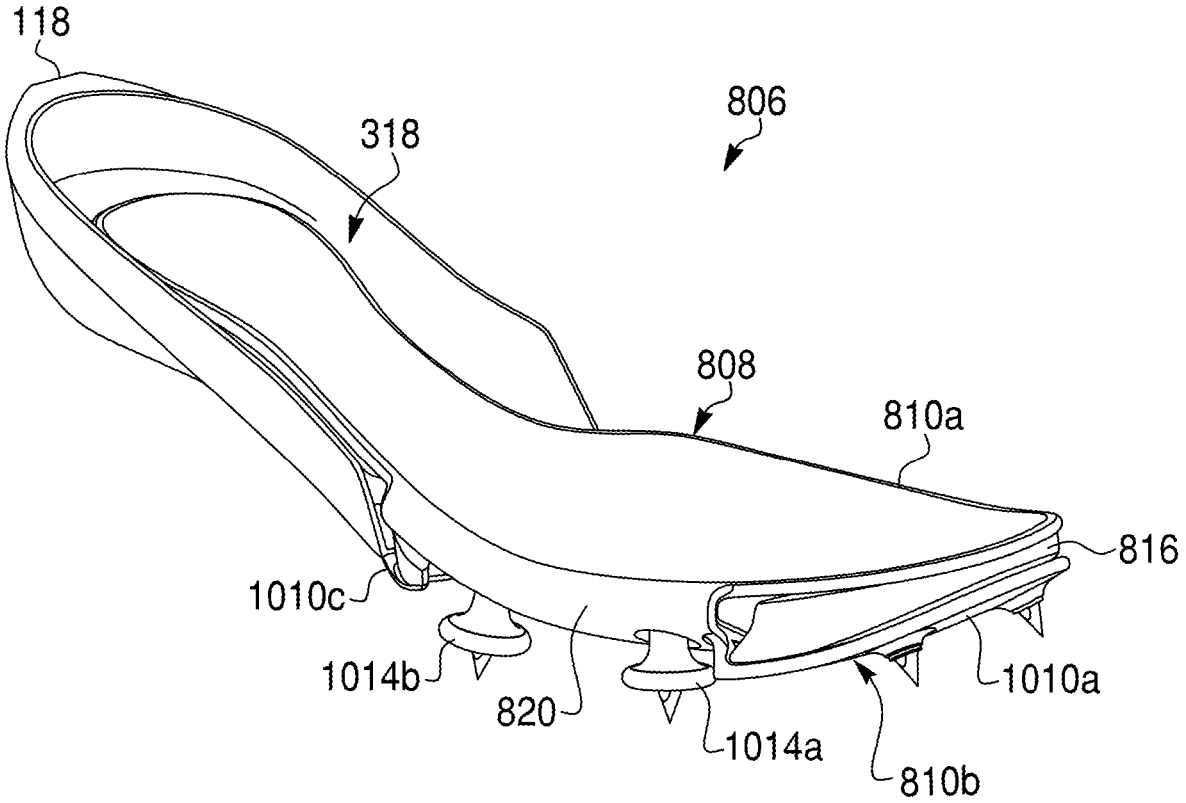
FIG. 11 is a top perspective view of the sole structure of FIG. 10A.
Figure 12:
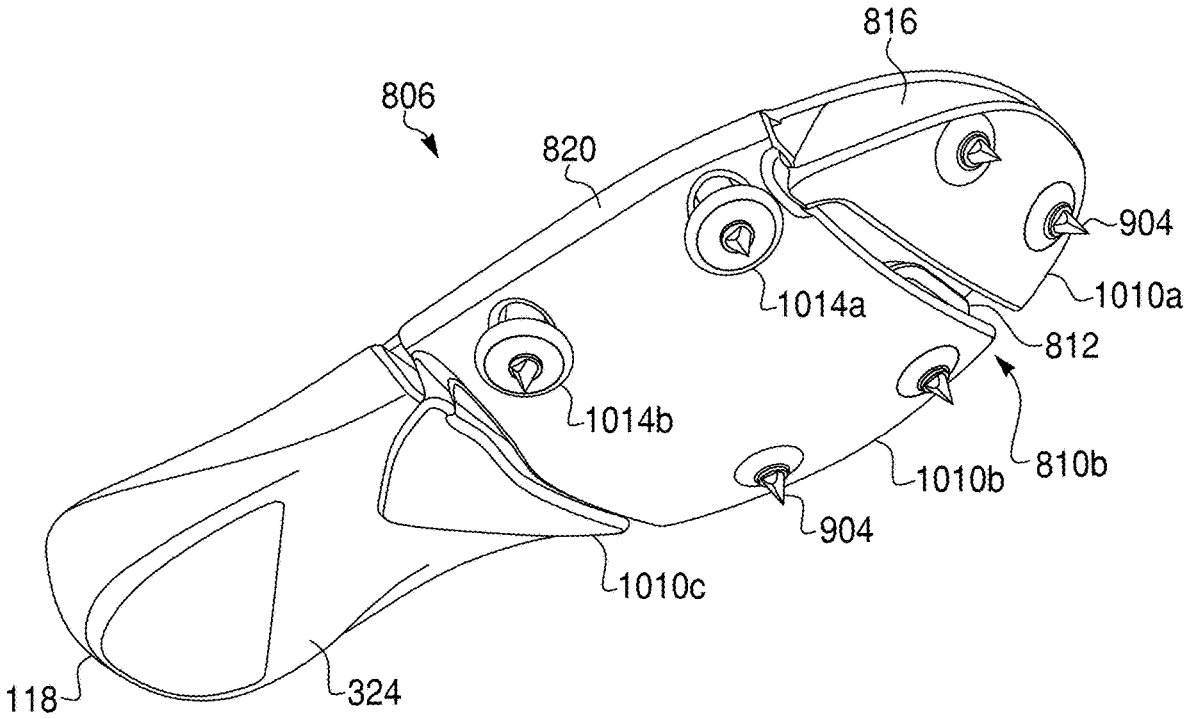
FIG. 12 is a bottom perspective view of the sole structure of FIG. 10A.

FIGS. 11 and 12 show the sole structure 806 in its fully assembled configuration. The first plate 810*a* and the second plate 810*b* are coupled to one another via the brace 820. The first cushioning element 812 and the second cushioning element 816 are adhered to one another within the sleeve 808. The first cushioning element 812 and the second cushioning element 816 may be adhered via an adhesive (e.g., glue). The first plate 810*a* of the sleeve 808 is disposed within the cavity 318. The third portion 1010*c* of the second plate 810*b* is disposed adjacent to the bottom surface 324 of the third cushioning element 118. The brace 820 provides a coupling between the first plate 810*a* and the second plate 810*b* on the lateral side 24 which allows the first plate 810*a* to move (e.g., pivot) toward the medial side 22 and the first cushioning element 812.

As will be described herein, to provide the banking angle relative to a ground surface shown in FIG. 13A, the first cushioning element 812 of the article of footwear 800 is positioned on the medial side 22. It should be appreciated that the banking angle is an angle formed along the second surface 1004 of the first plate 810*a* relative to the ground surface when the user of the article of footwear 800 is, for example, turning around a corner on a track.

Figure 13A:
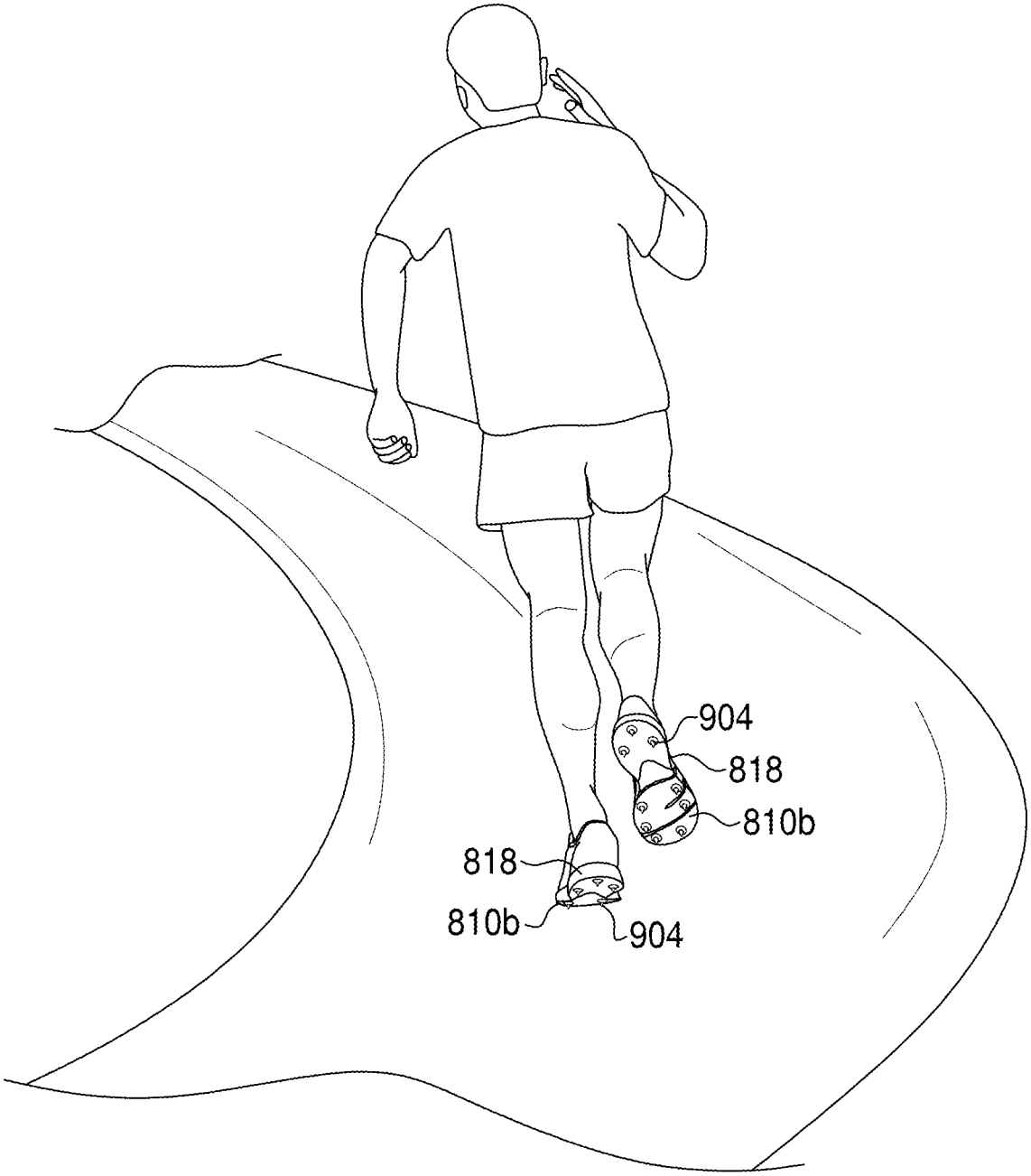
FIG. 13A is an exemplary view of a user wearing the article of footwear of FIG. 9.
Figure 13B:
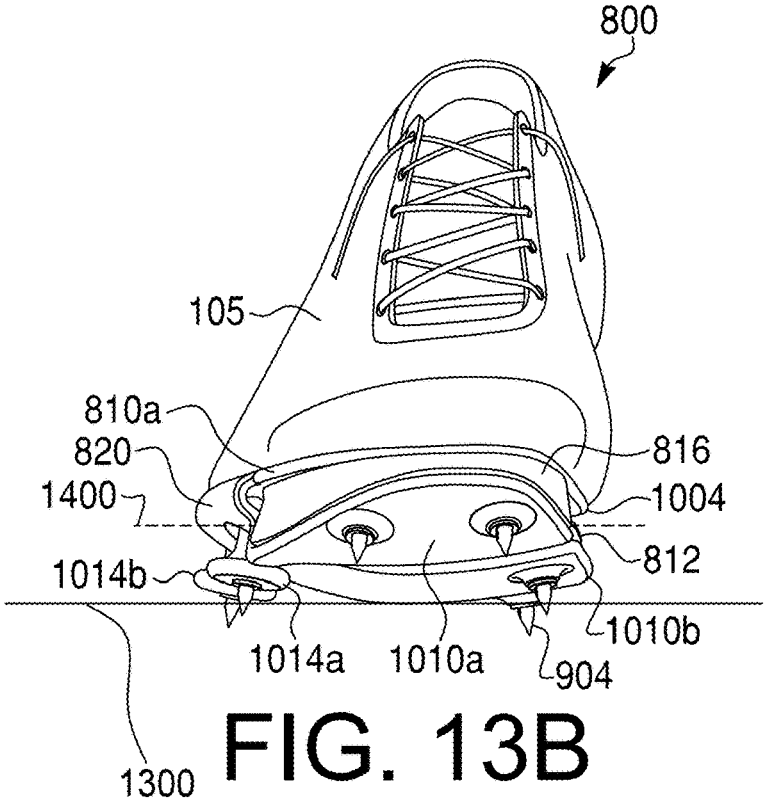
FIG. 13B is a front view of the article of footwear of FIG. 9 in a first configuration.
Figure 13C:
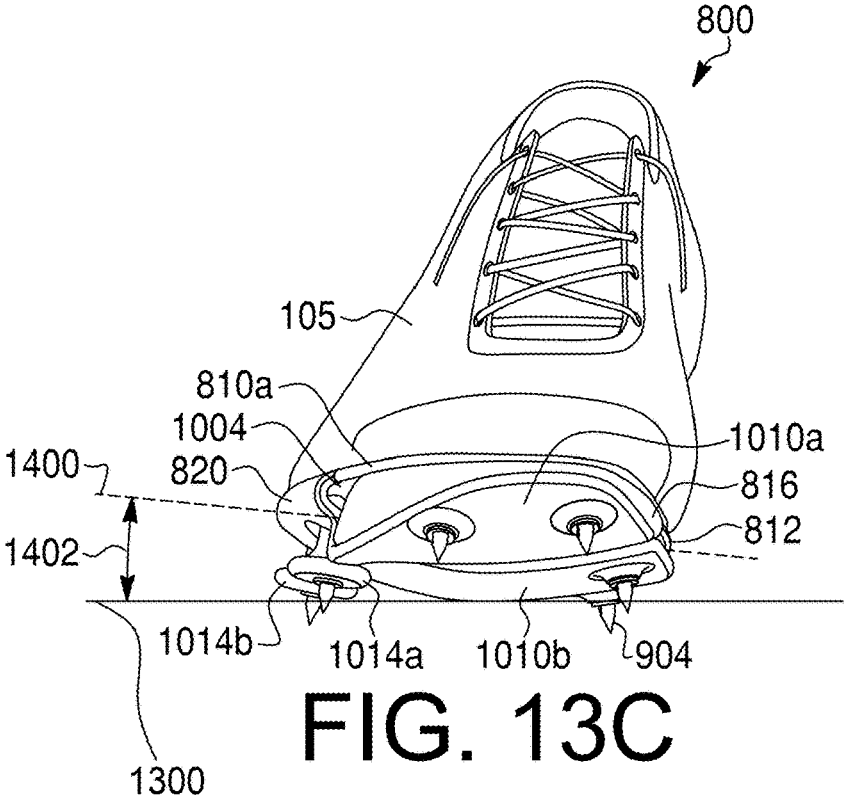
FIG. 13C is a front view of the article of footwear of FIG. 9 in a second configuration.

FIGS. 13A-13C show a changing banking angle for the article of footwear 800. FIG. 13A shows a user of the article of footwear 800 banking while using the article of footwear 800. As shown in FIG. 13B, a neutral position of the article of footwear 800 is shown when the user is running straight and a plane 1400 extending along the second surface 1004 of the first plate 810*a* is substantially parallel with ground surface 1300. In the neutral position, the article of footwear 800 is substantially parallel to the ground surface 1300 and has a minimum banking angle relative to the ground surface 1300, which in some examples will be approximately zero or a zero-banking angle.

As shown in FIG. 13C, a banked position of the article of footwear 800 is shown when the user is running along a bank (e.g., a sloped surface on a track) and the article of footwear 800 is configured to tilt to form an angle (e.g., a banking angle) 1402 between the ground surface 1300 and the plane 1400. As the user banks, the user's weight moves (e.g., pivots) the first plate 810*a* onto the first cushioning element 812. The first spike 1014*a* and the second spike 1014*b* are collectively configured to push the first plate 810*a* onto the first cushioning element 812 by leveraging against the ground surface 1300. The first plate 810*a* is configured to compress the first cushioning element 812. The first cushioning element 812 may be compressed to a maximum compression limit of the first cushioning element 812. As the user comes out of the bank, the first cushioning element 812 is configured to apply restorative forces to push the first plate 810*a* back towards the neutral position shown in FIG. 13B in response to the user exiting the bank and the user's weight shifting. As the first plate 810*a* returns to the neutral position after banking, the brace 820 keeps the first plate 810*a* from extending past the neutral position to still allow for shifting of the weight of the user while maintaining structural integrity of the sleeve 808. Additionally the spikes 1014*a*, 1014*b* are configured to dampen the movement of the sleeve 808 when the article of footwear 800 is coming out of the bank by reducing the distance between the first plate 810*a* and the ground surface 1300.

In some examples, the first cushioning element 812 may be fully compressed to about 100% of the compression limit of the first cushioning element 812. In some examples, the first cushioning element 812 may be partially compressed to any percentage of the compression limit of the first cushioning element 812 corresponding to the force applied by the user of the article of footwear 800. In some examples, the first cushioning element 812 may be partially compressed to about 75% of the compression limit of the first cushioning element 812. In some examples, the first cushioning element 812 may be partially compressed to about 50% of the compression limit of the first cushioning element 812. In some examples, the first cushioning element 812 may be partially compressed to about 25% of the compression limit of the first cushioning element 812.

The compression of the first cushioning element 812 provides the desired banking angle 1402, which can vary depending on application. For example, with a maximum banking angle 1402 of about 20 degrees, the desired banking angle would be able to vary between about 0 and about 20 degrees. In some examples, higher or lower maximum banking angles can be achieved. In some examples, the maximum banking angle 1402 is about 30 degrees. In some examples, the maximum banking angle 1402 is about 50 degrees. In some examples, the maximum banking angle 1402 is about 80 degrees. In some examples, the maximum banking angle 1402 is about 18 degrees. In some examples, the maximum banking angle 1402 is about 15 degrees. In some examples, the maximum banking angle 1402 is about 10 degrees.

As discussed above, the sole structures 106 and 806 described herein comprise an adaptive-height sole structure 106 and 806 that can vary the nature of the support of the sole structure 106 and 806 to provide an article of footwear 100 and 800 that supports the user's foot in a manner that can vary in angle, curvature, orientation, and/or shape of the surface receiving the user's foot. In this manner, the sole structure 106 and 806 can adapt or change to provide a desired form of cushioning, stability, support, and/or comfort in situations where a non-flat orientation of the wearer's foot is desirable. More specifically, the sole structure 106 and 806 can provide a desired form of cushioning, stability, support, and/or comfort during banking while the user is using the article of footwear 100 and 800 on a track. For example, the sole structure 106 and 806 can provide increased stability performance when the user is turning while walking or running on a track, such as when running counterclockwise on a curved portion of a track, as shown and described in FIGS. 8A and 13A.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

The following clauses provide an exemplary configuration for an article of footwear and sole structure described above.

Clause 1. An article of footwear comprising: an upper; and a sole structure coupled to the upper, the sole structure comprising: a sleeve extending from a first end to a second end, the sleeve including: a first plate having a first surface and a second surface opposite the first surface, the first plate extending from the first end to the second end; a second plate having a first surface and a second surface opposite the first surface of the second plate, the second plate extending from the first end toward the second end; a first cushioning element disposed on the medial side of the article footwear, wherein the first cushioning element is disposed between the first plate and the second plate; a second cushioning element coupled to the first plate; and a third cushioning element disposed between the first plate and the second plate.

Clause 2. The article of footwear of Clause 1, wherein the first cushioning element is a fluid-filled bladder.

Clause 3. The article of footwear of Clause 1, wherein the sleeve further includes a brace, the brace coupling the first plate to the second plate.

Clause 4. The article of footwear of Clause 3, wherein the brace is comprised of a flexible material.

Clause 5. The article of footwear of Clause 3, wherein the brace is disposed on a lateral side of the article of footwear.

Clause 6. The article of footwear of Clause 3, wherein the second plate includes a first portion, a second potion, and a third portion, the first portion and the second portion are separated by a first slot, and the second portion and the third portion are separated by a second slot.

Clause 7. The article of footwear of Clause 6, wherein a third slot extends within the second portion.

Clause 8. The article of footwear of Clause 6, wherein the first portion is a forward-most portion of the second plate, the third portion is a rear-most portion of the second plate, and the second portion is disposed between the first potion and the third portion.

Clause 9. The article of footwear of Clause 6, wherein the first portion and the second portion includes one or more traction elements, the one or more traction elements extending outwardly from the second surface of the second plate.

Clause 10. An article of footwear configured to transition between a neutral position and a banked position, the article of footwear comprising: an upper; and a sole structure coupled to the upper, the sole structure comprising: a sleeve extending from a first end to a second end, the sleeve including: a first plate having a first surface and a second surface opposite the first surface, the first plate extending from the first end to the second end; a second plate having a first surface and a second surface opposite the first surface, the second plate extending from the first end toward the second end; a brace coupling the first plate to the second plate, the brace comprising a flexible material; one or more spikes extending from the second surface of the first plate; and a first cushioning element disposed between the first plate and the second plate, the first cushioning element is configured to transition between a resting state and a compressed state, wherein in the resting state, a plane extending along the second surface of the first plate is parallel with a ground surface; wherein, in the compressed state, the plane extending along the second surface of the first plate forms an angle between the ground surface and the plane; wherein in the neutral position, the first cushioning element is in the resting state; and wherein in the banked position, the one or more spikes are configured to move the first plate onto the first cushioning element to transition the first cushioning element towards the compressed state.

Clause 11. The article of footwear of Clause 10, wherein the first cushioning element is a fluid-filled bladder.

Clause 12. The article of footwear of Clause 10, wherein the angle is greater than 0 degrees and less than 20 degrees.

Clause 13. The article of footwear of Clause 10, wherein the article of footwear is a right article of footwear of a pair of articles of footwear and the first cushioning element is positioned on a medial side of the right article of footwear.

Clause 14. The article of footwear of Clause 10, wherein the article of footwear is a left article of footwear of a pair of articles of footwear and the first cushioning element is positioned on a lateral side of the left article of footwear.

Clause 15. The article of footwear of Clause 10, wherein the second plate forms a ground-engaging surface of the article of footwear.

Clause 16. The article of footwear of Clause 10, wherein the second plate includes one or more traction elements extending outwardly from the second surface of the second plate.

Clause 17. An article of footwear comprising: an upper; and a sole structure coupled to the upper, the sole structure comprising: a sleeve extending from a first end to a second end, the sleeve including: a first plate having a first surface and a second surface opposite the first surface, the first plate extending from the first end to the second end; a second plate having a first surface and a second surface opposite the first surface of the second plate, the second plate extending from the first end toward the second end; a brace coupling the first plate to the second plate, the brace comprising a flexible material; a first cushioning element disposed between the first plate and the second plate, wherein a force applied to the first plate compresses the first cushioning element; and a second cushioning element including a first surface configured to receive the first plate, and a second surface disposed opposite the first surface of the second cushioning element.

Clause 18. The article of footwear of Clause 17, wherein the second plate further includes a first portion, a second potion, and a third portion, the first portion and the second portion are separated by a first slot, and the second portion and the third portion are separated by a second slot.

Clause 19. The article of footwear of Clause 18, wherein the third portion is disposed adjacent the second surface of the second cushioning element.

Clause 20. The article of footwear of Clause 18, wherein the first portion and the second portion each include one or more traction elements.

Clause 21. The article of footwear of Clause 20, wherein each of the first portion, the second portion, the third portion, and the second cushioning element form a portion of a ground-engaging surface of the article of footwear.

We claim:

1. An article of footwear comprising:

a medial side and a lateral side disposed opposite the medial side;

an upper; and a sole structure coupled to the upper, the sole structure comprising:

a sleeve extending from a first end to a second end, the sleeve including:

a first plate having a first surface and a second surface opposite the first surface, the first plate extending from the first end to the second end; and a second plate having a first surface and a second surface opposite the first surface of the second plate, the second plate extending from the first end toward the second end and extending from the medial side to the lateral side, and the second plate including at least a first slot extending from a medial side of the second plate to a lateral side of the second plate;

a brace coupling an edge on a lateral side of the first plate to an edge on the lateral side of the second plate;

a first cushioning element disposed on a medial side of the article of footwear, wherein the first cushioning element is disposed between the first plate and the second plate;

a second cushioning element coupled to the first plate; and a third cushioning element disposed between the first plate and the second plate.

2. The article of footwear of claim 1, wherein the first cushioning element is a fluid-filled bladder.

3. The article of footwear of claim 1, wherein the brace is comprised of a flexible material.

4. The article of footwear of claim 1, wherein the brace is disposed on a lateral side of the article of footwear.

5. The article of footwear of claim 1, wherein the second plate includes a first portion, a second portion, and a third portion, the first portion and the second portion are separated by the first slot, and the second portion and the third portion are separated by a second slot.

6. The article of footwear of claim 5, wherein a third slot extends within the second portion.

7. The article of footwear of claim 5, wherein the first portion is a forward-most portion of the second plate, the third portion is a rear-most portion of the second plate, and the second portion is disposed between the first portion and the third portion.

8. The article of footwear of claim 5, wherein the first portion and the second portion includes one or more traction elements, the one or more traction elements extending outwardly from the second surface of the second plate.

9. An article of footwear configured to transition between a neutral position and a banked position, the article of footwear comprising:

an upper; and a sole structure coupled to the upper, the sole structure comprising:

a sleeve extending from a first end to a second end, the sleeve including:

a first plate having a first surface and a second surface opposite the first surface, the first plate extending from the first end to the second end;

a second plate having a first surface and a second surface opposite the first surface, the second plate extending from the first end toward the second end, wherein the second plate includes one or more traction elements extending outwardly from the second surface of the second plate; and a brace coupling the first plate to the second plate, the brace comprising a flexible material;

one or more spikes extending from the second surface of the first plate; and a first cushioning element disposed between the first plate and the second plate, the first cushioning element is configured to transition between a resting state and a compressed state, wherein in the resting state, a plane extending along the second surface of the first plate is parallel with a ground surface;

wherein, in the compressed state, the plane extending along the second surface of the first plate forms an angle between the ground surface and the plane;

wherein in the neutral position, the first cushioning element is in the resting state; and wherein in the banked position, the one or more spikes are configured to move the first plate onto the first cushioning element to transition the first cushioning element towards the compressed state.

10. The article of footwear of claim 9, wherein the first cushioning element is a fluid-filled bladder.

11. The article of footwear of claim 9, wherein the angle is greater than 0 degrees and less than 20 degrees.

12. The article of footwear of claim 9, wherein the article of footwear is a right article of footwear of a pair of articles of footwear and the first cushioning element is positioned on a medial side of the right article of footwear.

13. The article of footwear of claim 9, wherein the article of footwear is a left article of footwear of a pair of articles of footwear and the first cushioning element is positioned on a lateral side of the left article of footwear.

14. The article of footwear of claim 9, wherein the second plate forms a ground-engaging surface of the article of footwear.

15. An article of footwear comprising:

an upper; and a sole structure coupled to the upper, the sole structure comprising:

a sleeve extending from a first end to a second end, the sleeve including:

a first plate having a first surface and a second surface opposite the first surface, the first plate extending from the first end to the second end;

a second plate having a first surface and a second surface opposite the first surface of the second plate, the second plate extending from the first end toward the second end;

a brace coupling the first plate to the second plate, wherein the brace extends between the second surface of the second plate and an outer edge of the first plate, the brace comprising a flexible material configured to allow the first plate to move relative to a medial-lateral axis of the article of footwear; and at least one spike extending from the first plate, through the brace, forming a portion of a ground-engaging surface of the sole structure;

a first cushioning element disposed between the first plate and the second plate, wherein a force applied to the first plate compresses the first cushioning element; and a second cushioning element including a first surface configured to receive the first plate, and a second surface disposed opposite the first surface of the second cushioning element.

16. The article of footwear of claim 15, wherein the second plate further includes a first portion, a second portion, and a third portion, the first portion and the second portion are separated by a first slot, and the second portion and the third portion are separated by a second slot.

17. The article of footwear of claim 16, wherein the third portion is disposed adjacent the second surface of the second cushioning element.

18. The article of footwear of claim 16, wherein the first portion and the second portion each include one or more traction elements.

* * * * *